US005771557A

United States Patent [19]

Contrasto

[11] Patent Number: 5,771,557

[45] **Date of Patent: *Jun. 30, 1998**

[54] CONCRETE INTERNAL METAL STITCHING

[76] Inventor: Sam Contrasto, 307 Palm Ave., Nokomis, Fla. 34275

[21] Appl. No.: 754,386

[22] Filed: Nov. 21, 1996

[ * ] Notice: The term of this patent shall not extend beyond the expiration date of Pat. No. 5,476,340.

[51] Int. Cl.[6] ..... B23P 6/00

[52] U.S. Cl. ..... 29/402.11; 29/402.18; 29/460; 29/530; 264/36

[58] Field of Search ..... 29/402.01, 402.09, 29/402.11, 402.18, 460, 530; 264/36

[56] References Cited

U.S. PATENT DOCUMENTS

| | | | |
|---|---|---|---|
| 379,510 | 3/1888 | Eynon | 29/402.11 |
| 3,619,893 | 11/1971 | Harris | 29/402.11 |
| 4,507,024 | 3/1985 | Martinak | 404/75 |
| 5,476,340 | 12/1995 | Contrasto | 404/75 |

FOREIGN PATENT DOCUMENTS

| | | | |
|---|---|---|---|
| 725861 | 4/1980 | U.S.S.R. | 29/402.09 |
| 1009688 | 4/1983 | U.S.S.R. | 29/402.01 |
| 1660922 | 7/1991 | U.S.S.R. | 29/402.01 |

*Primary Examiner*—David P. Bryant
*Attorney, Agent, or Firm*—Frank A. Lukasik

[57] ABSTRACT

An internal metal stitching method for repairing cracks in concrete comprising the steps of cutting slots to facilitate metal stitching brackets installed in saw cuts every two feet and at alternating angles to the crack. The concrete is marked using a stitching bracket as a template for marking out the concrete saw cuts. The saw cuts are made in the concrete following the outline of the bracket. The first cut is made along the length of the large bracket and the second and third cuts are made near the ends of each large bracket to accommodate end brackets which when fitted resemble a double "t". The saw cuts are cleaned and dried, filled with a filler resin, and the metal brackets are inserted and are submerged to ¼" below the concrete surface. The filler is smoothed out to a level flush with the concrete surface. Additional decorative surfaces may then be applied, such as ceramic tiles, carpeting, linoleum or paint. Various shaped metal stitching brackets and a bracket made of filler are also disclosed.

5 Claims, 26 Drawing Sheets

CONCRETE INTERNAL METAL STITCHING

BACKGROUND OF THE INVENTION

1. Field of the Invention

This invention relates generally to concrete crack repair and more specifically to concrete internal metal stitching and a cost effective method for restoring the tensile strength to a cracked concrete section.

2. Description of the Prior Art

Concrete stitching is a simple, cost effective technique for restoring the tensile strength to a cracked concrete section. It also can increase the shear capacity of flexural members. Most repair contractors already have the necessary equipment and tools to stitch cracks.

The most common stitching methods use either stitching dogs (U-shaped metal units), thin metal interlocking plates, or dowel bars for reinforcement. In each method, the reinforcement is installed across the crack and is bonded to each side of the crack with epoxy or cementitious materials. The amount of reinforcement can be varied to achieve the desired strength restoration. Unlike interlocking plates and dowel bars, which are embedded in the concrete, stitching dogs are surface mounted. Concrete in axial tension, therefore, requires stitching dogs on both faces. Stitching dogs are most effective when restoring tension in bending members since they are placed at the critical location-the tension face.

To install stitching dogs, holes are drilled on both sides of the crack, the holes are cleaned, and the legs of the dog are anchored in the holes with nonshrink grout or epoxy. The length, orientation, and location of the stitching dogs are varied so that the tension is transmitted across the area, not across a single plane within the section.

Because dogs are thin and long and aren't supported laterally, they cannot take much compressive force. If the crack closes as well as opens, the dogs must be stiffened and strengthened to prevent buckling. One method to prevent buckling is to embed the dogs in an overlay.

Dowel bars are also used to repair concrete cracks. To install dowel bars, two holes are drilled diagonally through the crack, one from each side. The holes are filled with nonshrink cementitious or epoxy materials, then a dowel bar is driven into each hole. The bonded dowel bars transmit force across the crack face. The angled dowel bars restore shear transfer and transmit axial tension, but aren't very effective for restoring tension in flexural members.

Because dogs are thin and long, and aren't supported laterally, they cannot take much compressive force. If the crack closes as well as opens, the dogs must be stiffened and strengthened to prevent buckling. The angled dowel bars restore shear transfer and transfer axial tension, but aren't very effective for restoring tension in flexural members.

In my prior art patent U.S. Pat. No. 5,476,340, I have disclosed a method of using internal metal stitching for repairing cracks in concrete, In that patent, small end brackets are fitted that resemble a double "T". The end brackets lock and stabilize the large brackets. I have since found that welding the end brackets or otherwise forming the metal stitching to provide a solid structure to further reinforce the stitching and provide additional strength. The metal stitching of this invention may be constructed of various configurations.

SUMMARY OF THE INVENTION

The invention is a system for repairing concrete cracks. A concrete saw is used to cut slots to facilitate large metal brackets installed every 2 feet and at alternating angles to the crack. Small end brackets are fitted that resemble a double "T". The end brackets lock and stabilize the large brackets. The slots are then cleaned and dryed, filled with a resin filler mix and the metal brackets are submerged ¼" below the concrete surface where they solidify within the filler. If possible, a new control cut is made to relieve stresses from the repair area. The excess filler is ground flush when dry or scraped off when liquid (soft), and the surface can be coated with a variety of materials such as polymer modified cement acrylic stain and clear sealers.

DESCRIPTION OF THE PREFERRED EMBODIMENT

Figure 1:
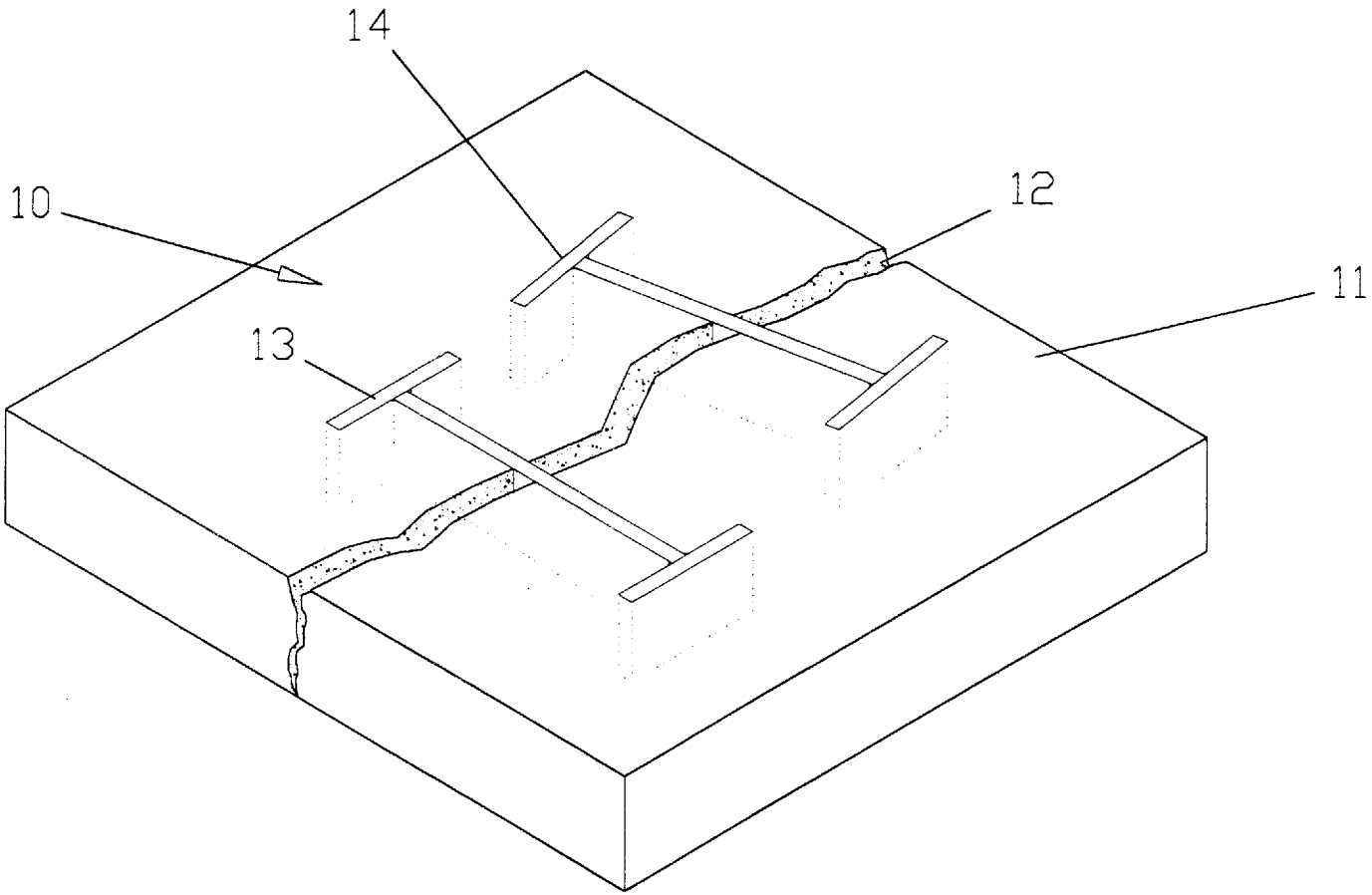
FIG. 1 is a top perspective view of the double "T" assembly of the metal brackets of the invention embedded in concrete.
Figure 2:
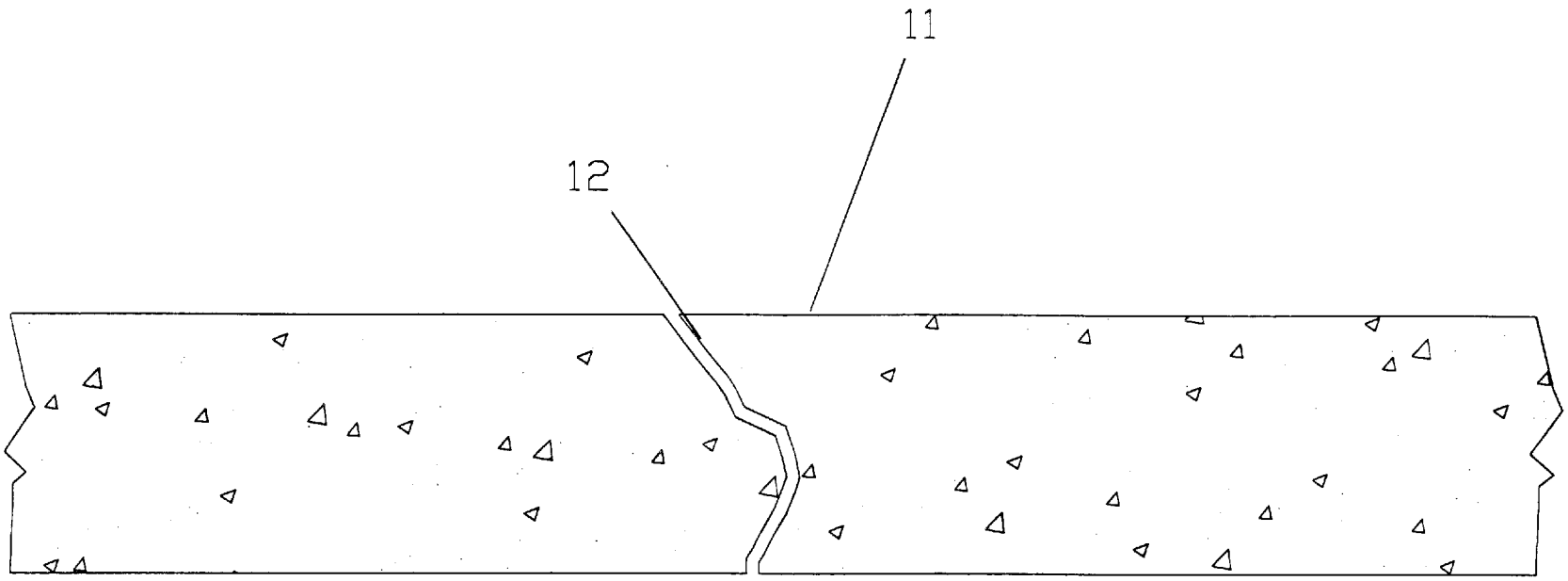
FIG. 2 is a cross section of a section of concrete showing a crack.
Figure 3:
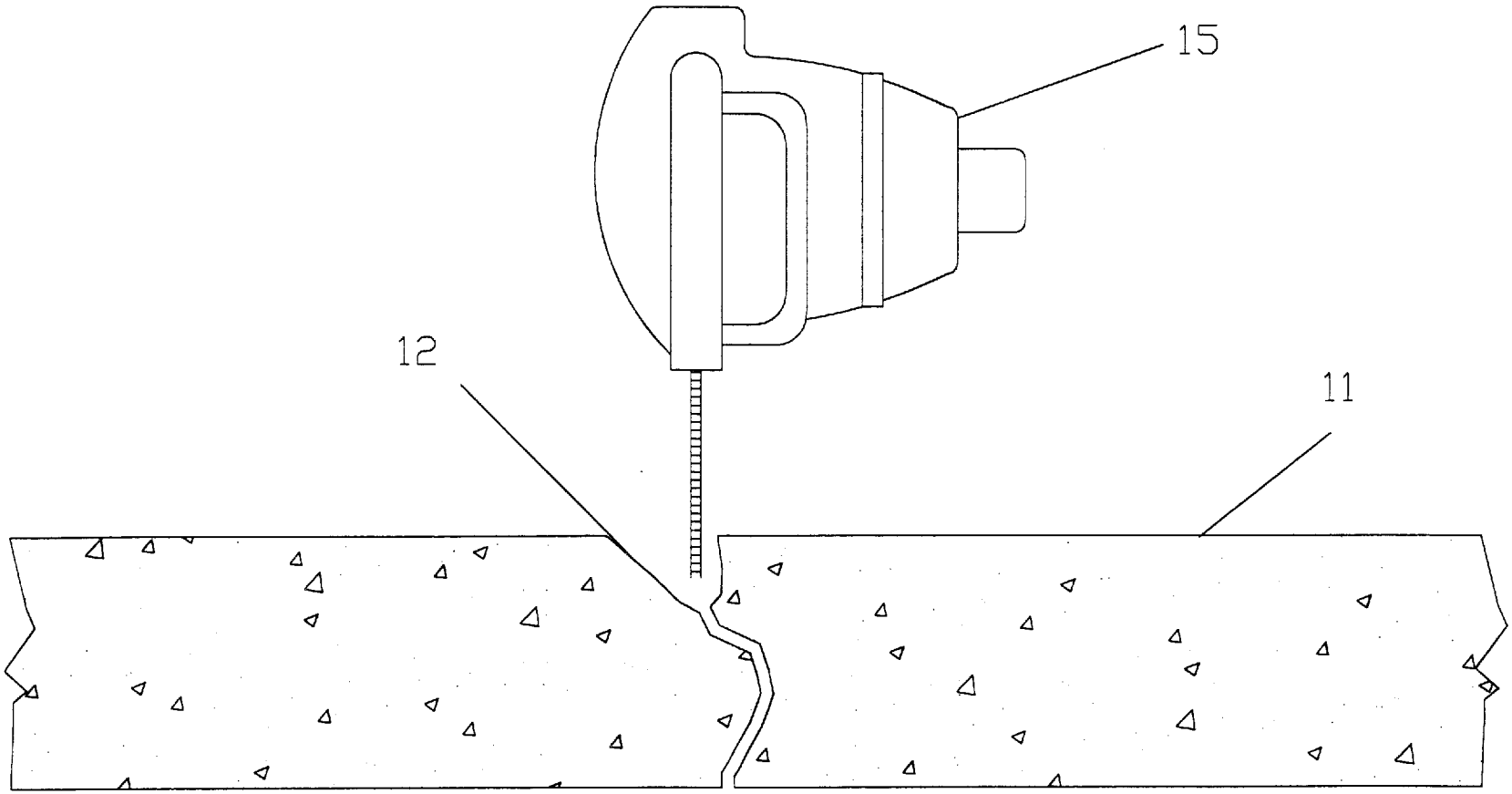
FIG. 3 is a side view of a concrete saw cleaning out a concrete crack.
Figure 4:
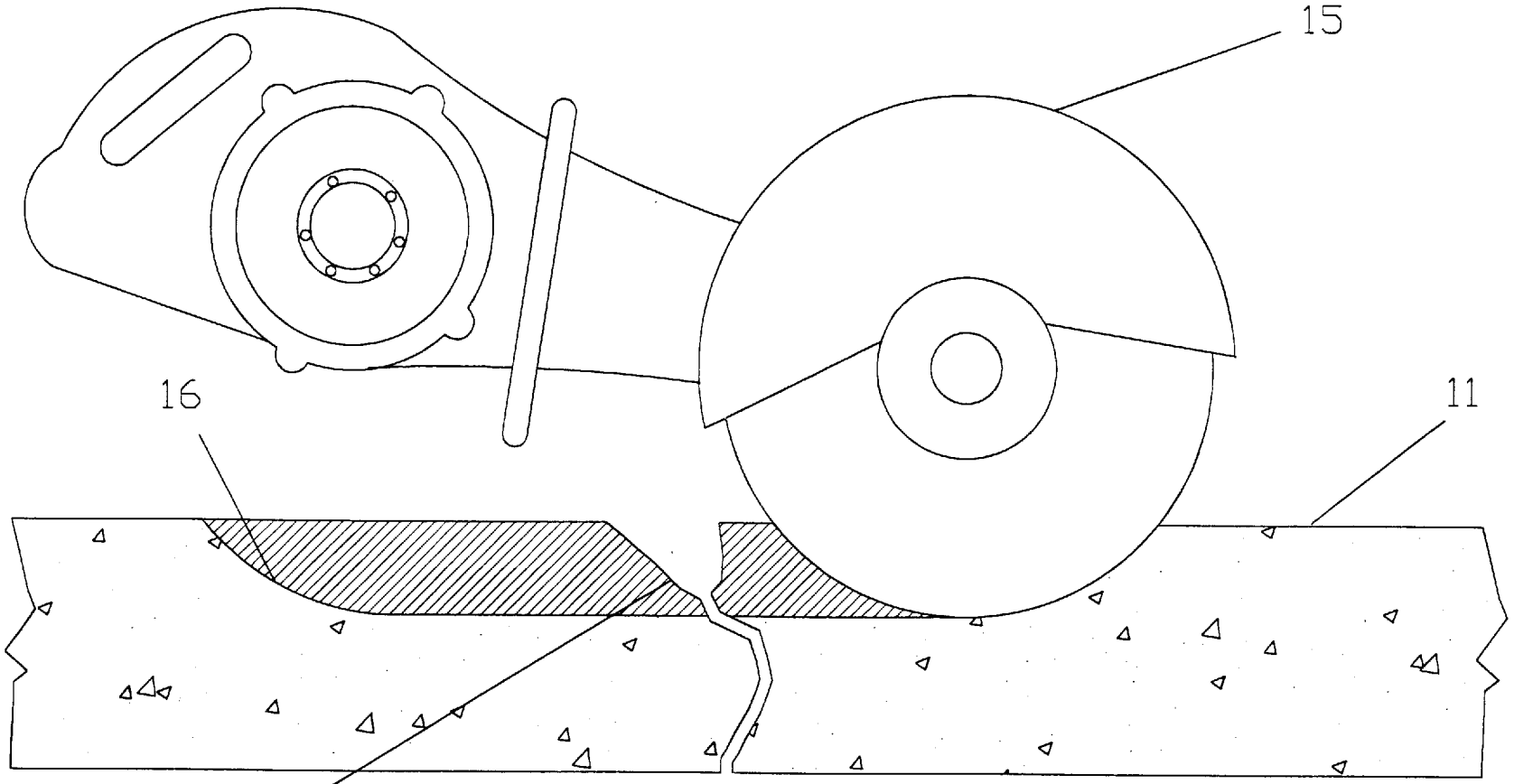
FIG. 4 is a side view of a hand saw making a cut in a concrete slab, partially in section.
Figure 5:
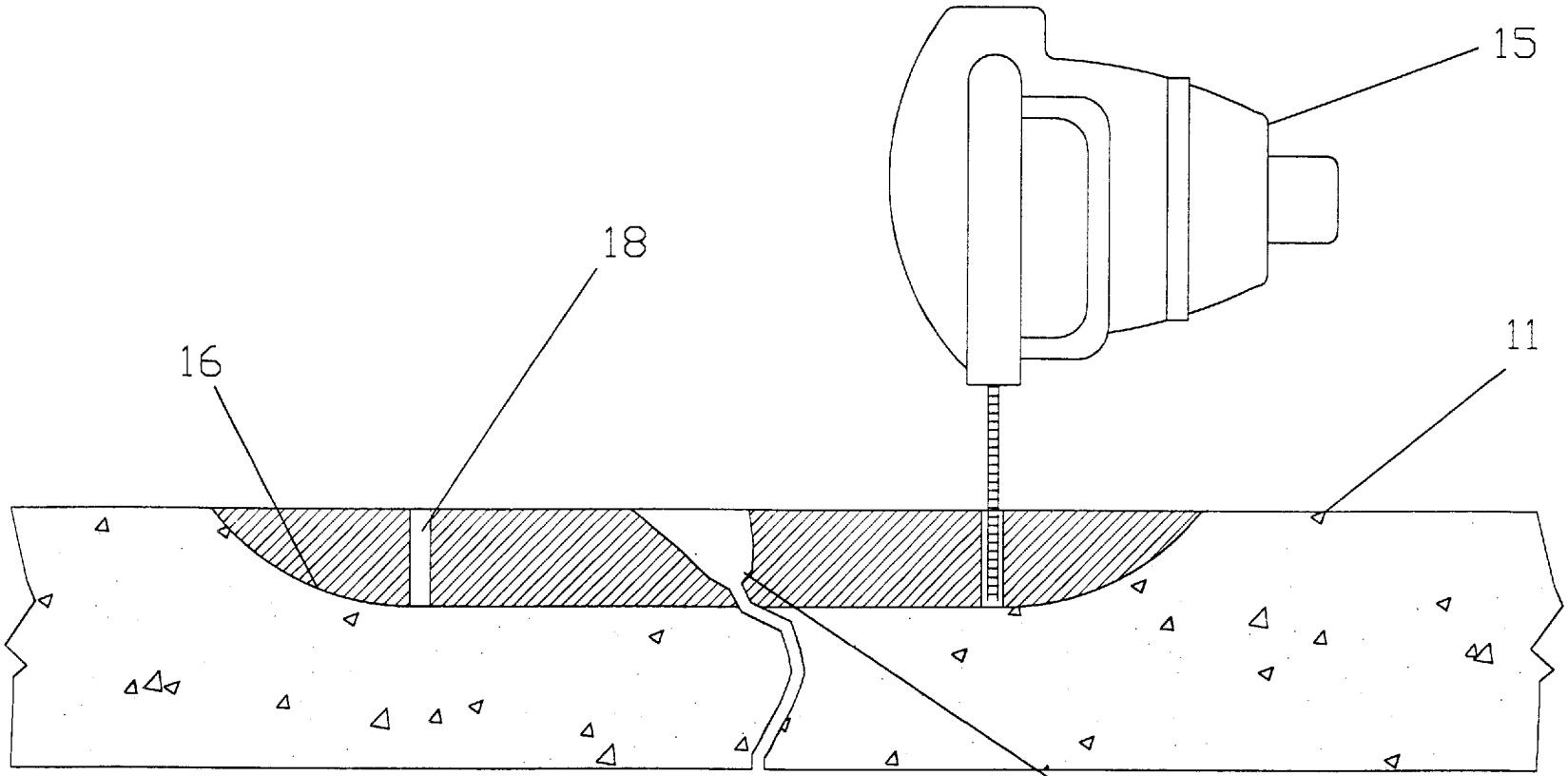
FIG. 5 is a side view, partially in section, of a finished saw cut in a concrete section.

FIG. 1 is a top view of the metal stitching brackets 10 installed in a concrete section depicted by the numeral 11 and having a crack repaired by the concrete internal metal stitching system and method of the invention. Top surface of concrete section 11 is shown with a crack 12 having the assembly of two metal stitching brackets 10 set in slits cut in the concrete 11 at angles to the crack 12. FIG. 2 is a side sectional view showing a crack in the concrete section before repair by the method and system of the invention.

The first step of the process of the invention is to rout the crack 12 with a 12" or 14" concrete saw 15 with standard masonry blades or diamond blades available at most tool rental shops. It is important to remove all of the loose pieces of concrete from the crack to permit better bonding of a crack filler 20.

Figure 6:
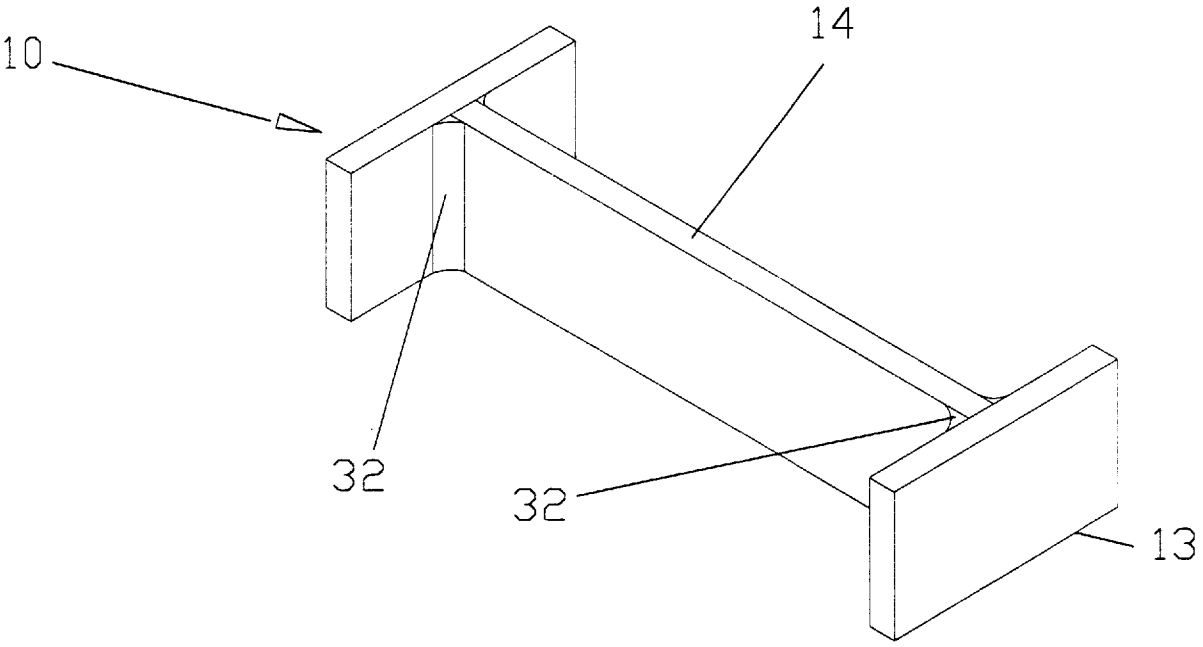
FIG. 6 is a top perspective view of the double "T" assembly of the metal brackets.

Using a bracket 10, consisting of the pre-assembled end brackets 13 and large brackets 14 as a guide, as shown in FIG. 6, the concrete crack 12 to be repaired is marked with an appropriate marking element to the dimensions to be cut.

Wearing safety glasses and dust mask, concrete saw cuts 16 are made at alternating, approximately 60° angles, to crack 12 and other angles as permitted, on the previously made marks which are spaced approximately 2 feet apart from each other. Saw cuts 18 are made at opposite ends of saw cuts 16. The saw cuts may be made with a standard hand held concrete saw 15 to facilitate the insertion of the metal brackets 10, or other embodiments such as, end metal brackets 13 and 27 and large metal brackets 14 and 29 shown in FIGS. 14 and 15. The saw cuts 16 and 18 are cut one quarter inch below the concrete 11 slab top surface.

Figure 24:
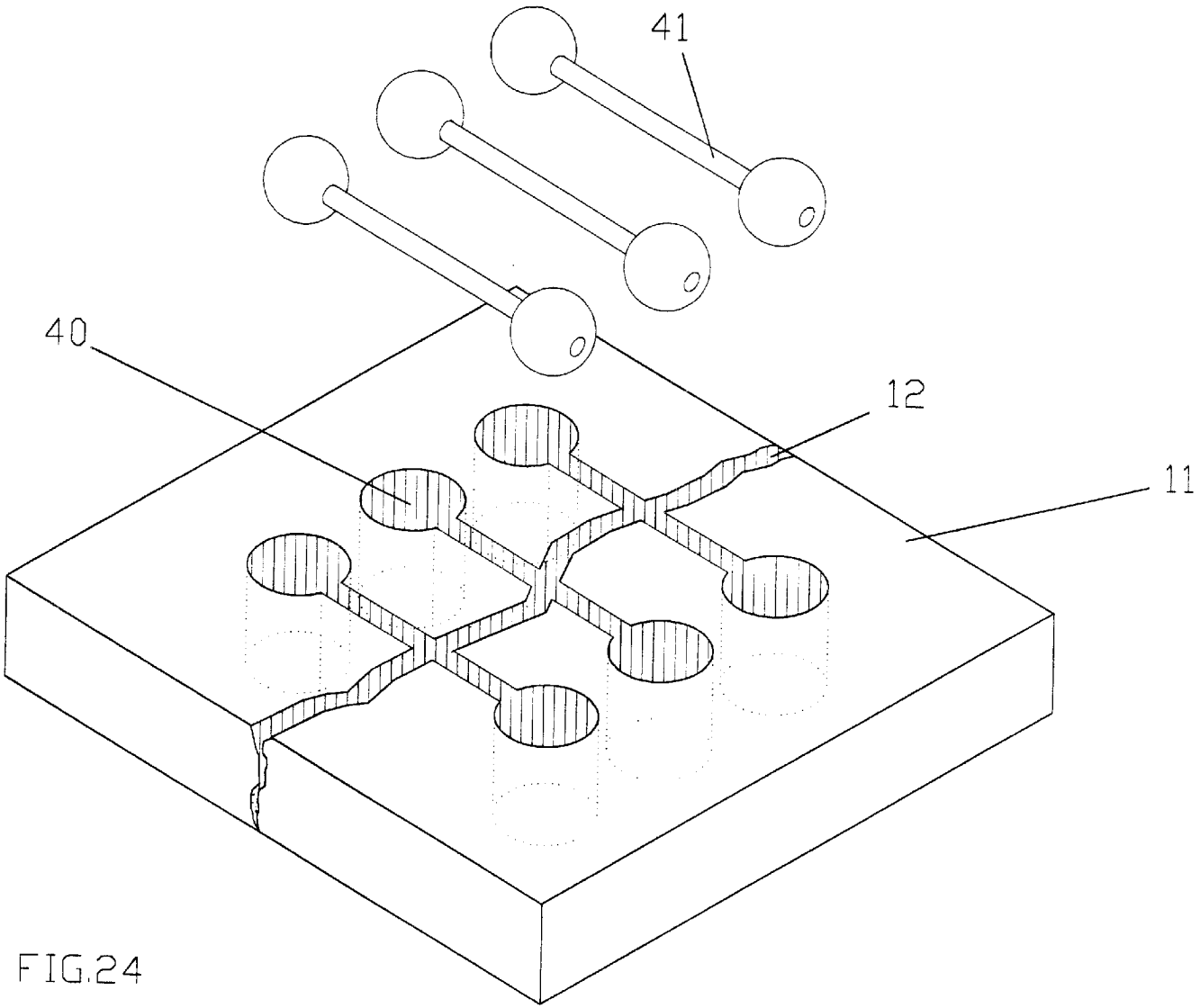
FIG. 24 is a top perspective view of an alternate embodiment of the welded metal brackets.

Appropriate saw cuts may also be made to accommodate the various shapes shown in FIGS. 24–30. FIG. 24 shows another embodiment which includes round holes 40 which may be drilled at the ends of saw cuts 16 or drilled and then connected by saw cuts 16. In a process used to repair highways, holes 40 are drilled through the entire slab and concrete or foam material are injected through the holes 40, under the slab 11, with sufficient pressure to raise the slab 11 a selected distance. When the concrete injection is completed, the holes 40 and the saw cuts 16 are filled with crack filler 20, metal bracket 41 is inserted and the process is completed as stated above.

Figure 28:
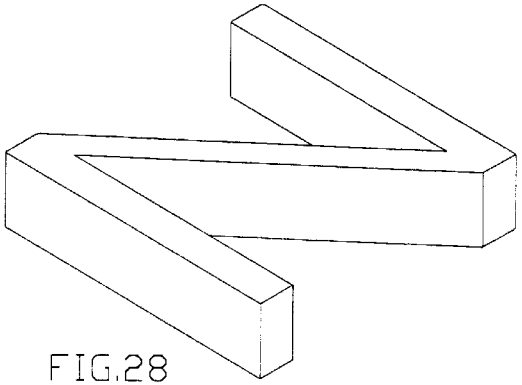
FIG. 28 is a top perspective view of a "Z" shaped rectangular metal bracket.
Figure 29:
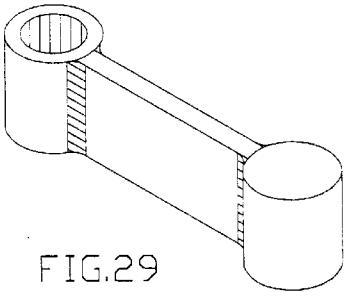
FIG. 29 is a top perspective view of a fourth alternate embodiment of the metal bracket.
Figure 30:
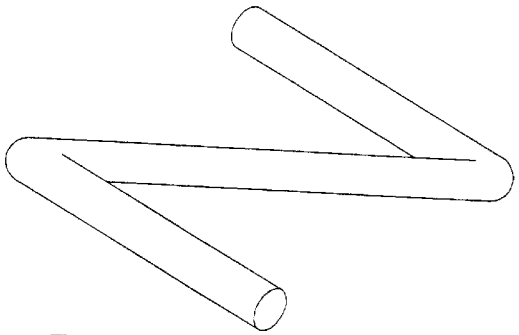
FIG. 30 is a top perspective view of of a "Z" shaped round metal bracket.
Figure 25:
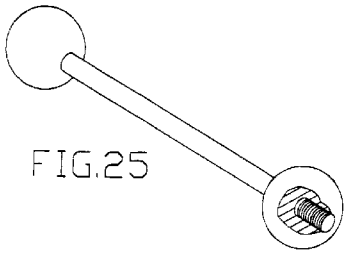
FIGS. 25 and 26 are top perspective views of a second alternate embodiment of the metal bracket.
Figure 26:
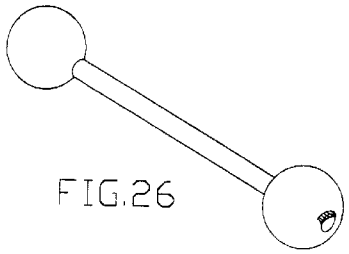
Figure 27:
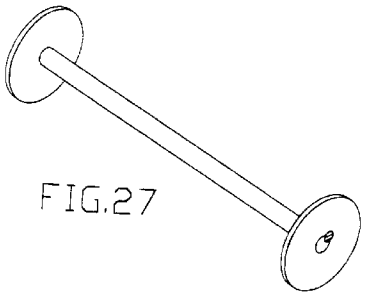
FIG. 27 is a top perspective view of a third alternate embodiment of the metal bracket.

The metal brackets shown in FIGS. 26 and 29 may also be inserted in the same manner as metal bracket 41. FIG. 25 shows the end bracket fastened to the large bracket by threading by a screw end on the large bracket. FIG. 26 shows the two brackets welded together at the outside end of the large bracket. FIG. 27 shows the end brackets in the form of washers welded at the end of the large bracket. FIG. 29 shows a hollow cylindrical end bracket and a solid cylindrical end bracket each welded at opposite ends of the large bracket. FIG. 28 shows rectangular end brackets welded at an angle at each end of the large bracket to form a "Z" shaped metal stitching bracket 10. FIG. 30 shows a round metal rod having the end brackets formed at an angle at each end of the large bracket to form a "Z" shaped metal stitching bracket 10.

Figure 31:
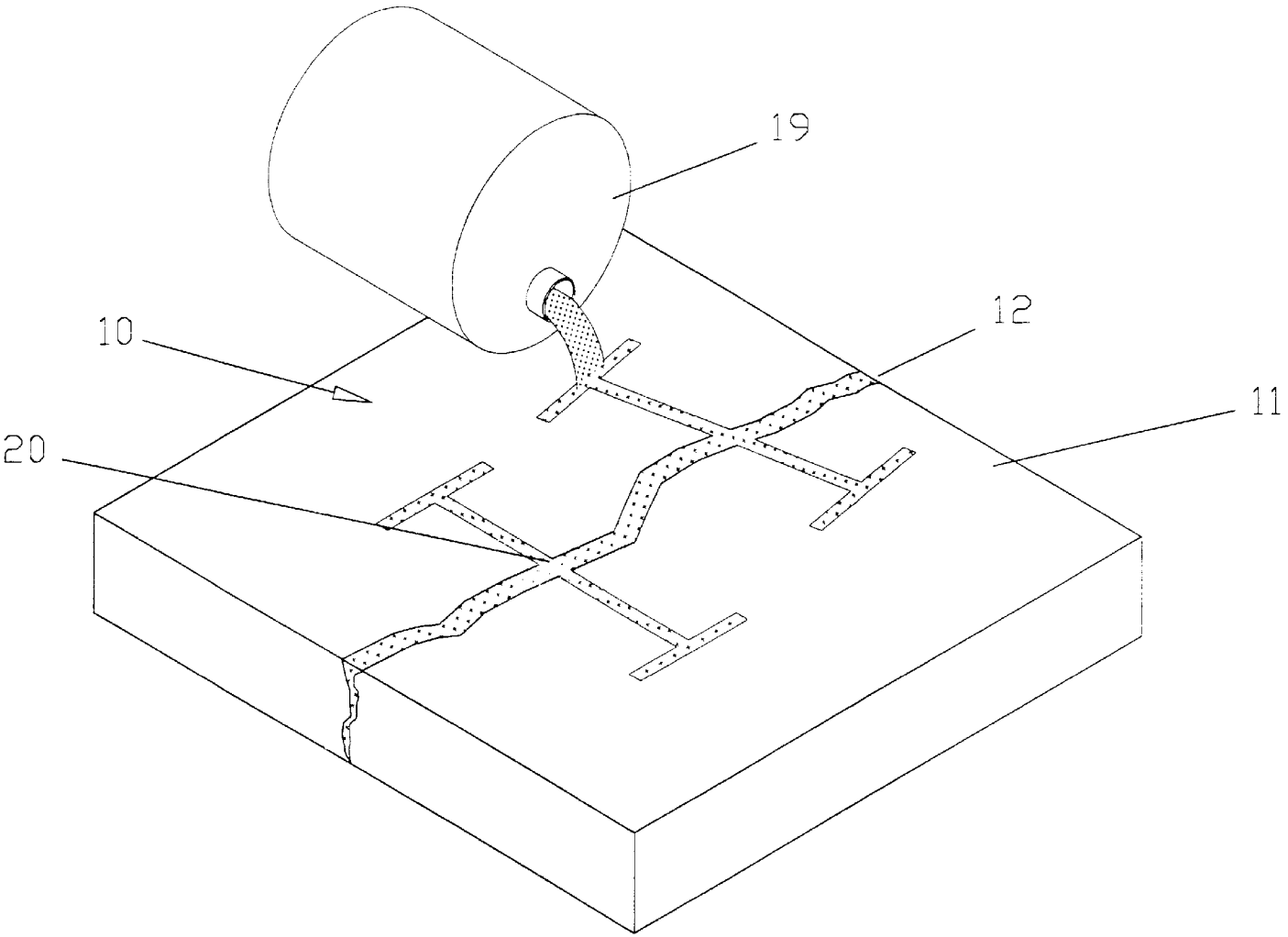
FIG. 31 is a top perspective view of a concrete internal stitching bracket made of a polyester epoxy resin filler.

In a preferred embodiment, the saw cut 16 was large enough to accommodate a large metal bracket 14, 14" long, 2½" high, and ⅛" thick, with the top surface of the large bracket 14, ¼" below the top surface of concrete section 11. The various embodiments discussed above may be formed at near the same dimensions. In FIG. 31, the saw cuts are completely filled with crack filler 20 and the strength of the filler 20 is used rather as the stitching bracket rather than inserting a metal bracket as discussed above. Reinforcing materials such as fiberglass or metal strands may also be used with the crack filler to form a polyester epoxy resin bracket.

Figure 7:
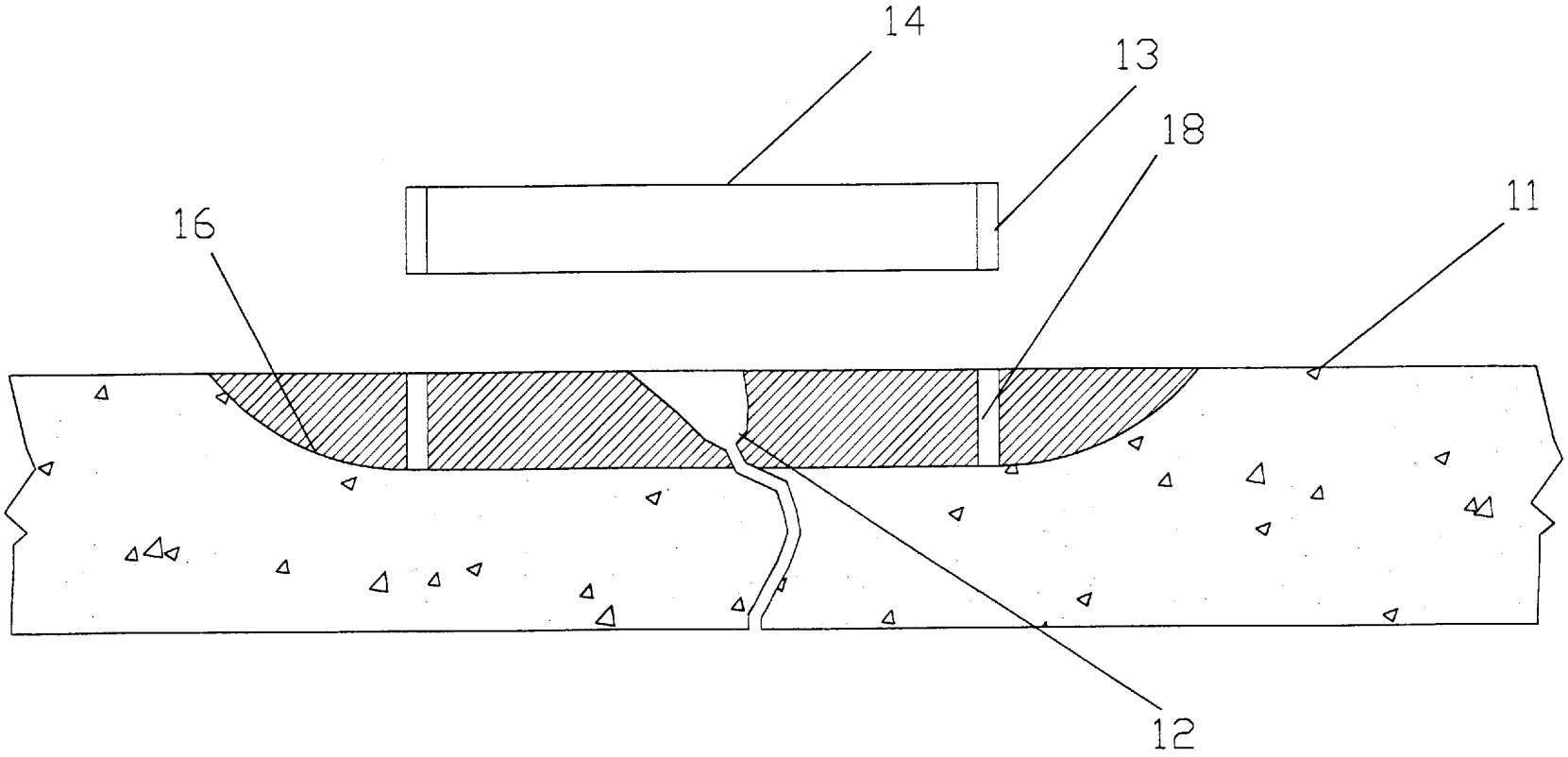
FIG. 7 is a side view of a double "T" metal bracket being inserted into a saw cut.
Figure 8:
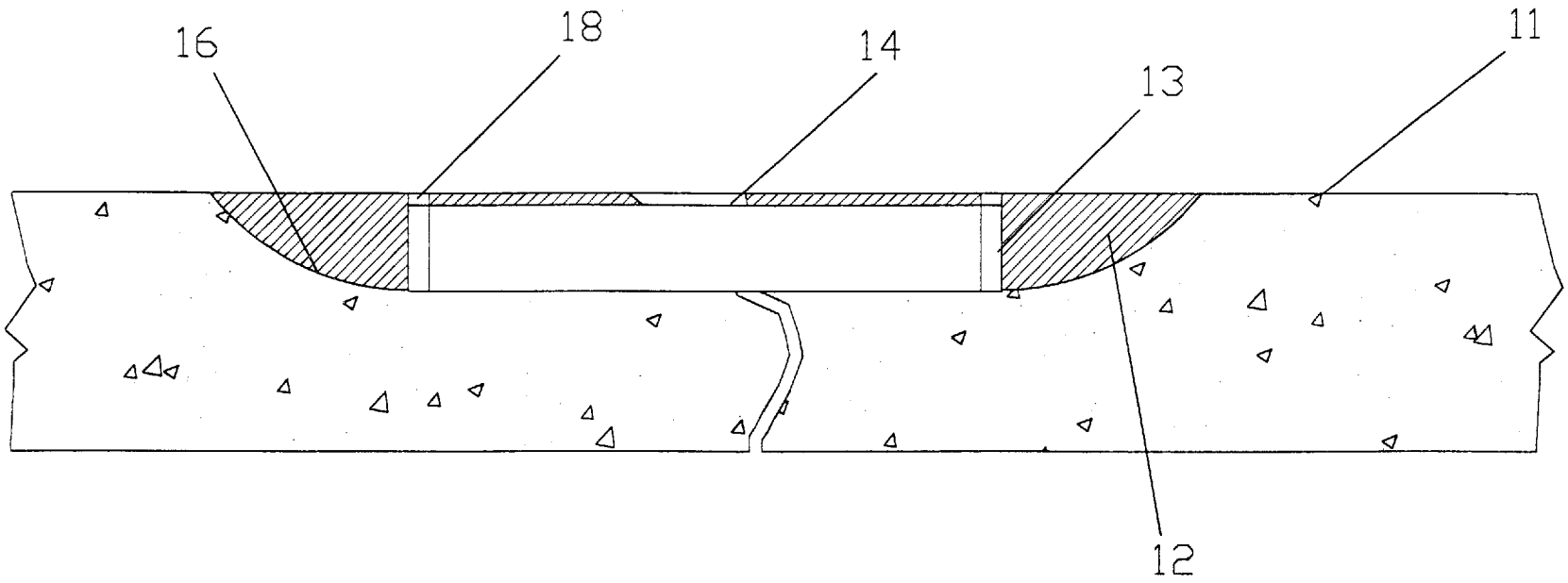
FIG. 8 is a side view of a double "T" metal bracket seated in the saw cut in the concrete slab.
Figure 9:
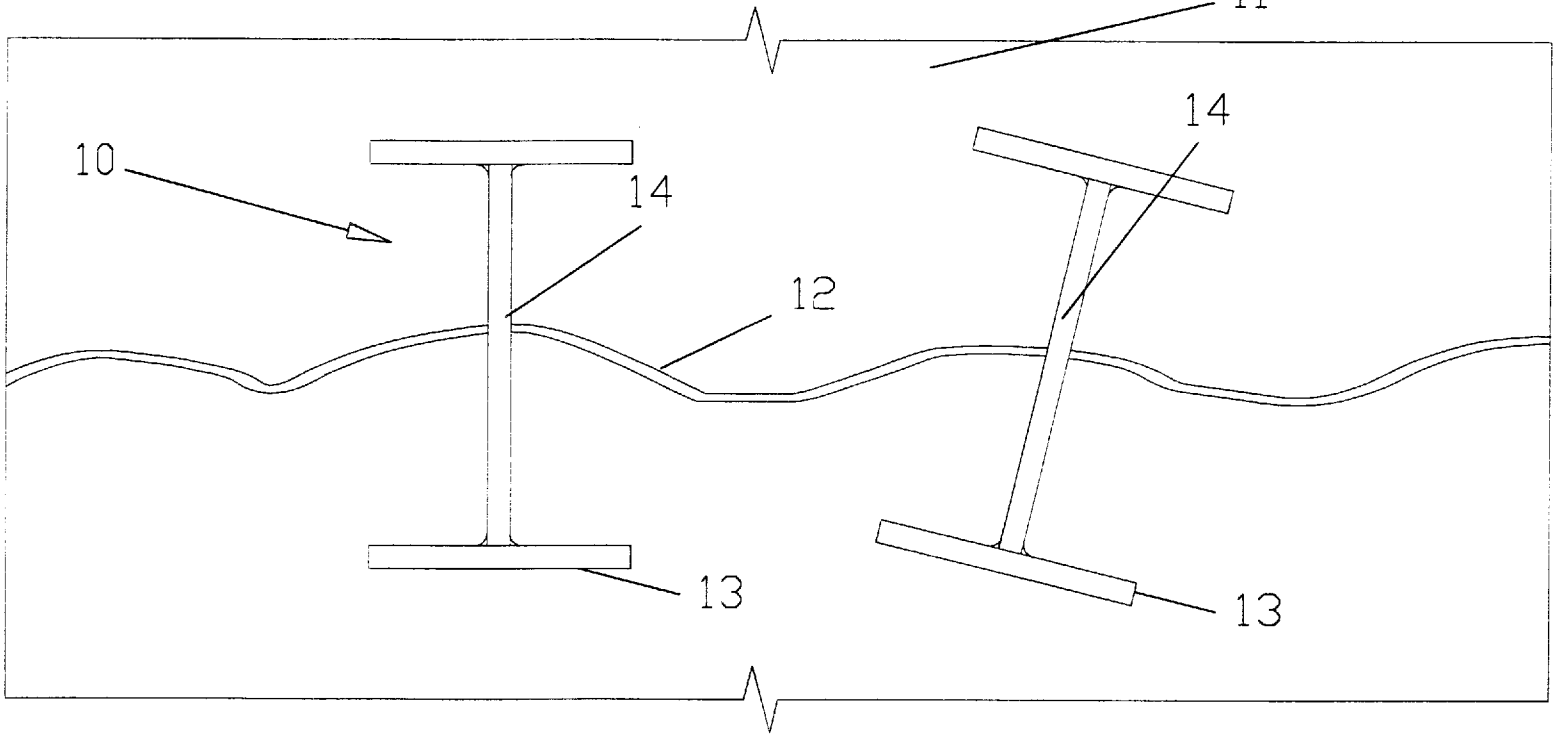
FIG. 9 is a top view of two double "T" metal brackets inserted across a concrete crack.

FIG. 6 shows a metal stitching bracket 10 which consists of large bracket 14 with two end brackets 13 welded as at 32 at opposite ends of large bracket 14. As shown in FIGS. 7 and 8, the bracket 10 is then inserted into the slots 16 and 18. FIG. 9 shows a top view of two metal stitching brackets 10 inserted in the saw cuts 16 and 18.

Figure 10:
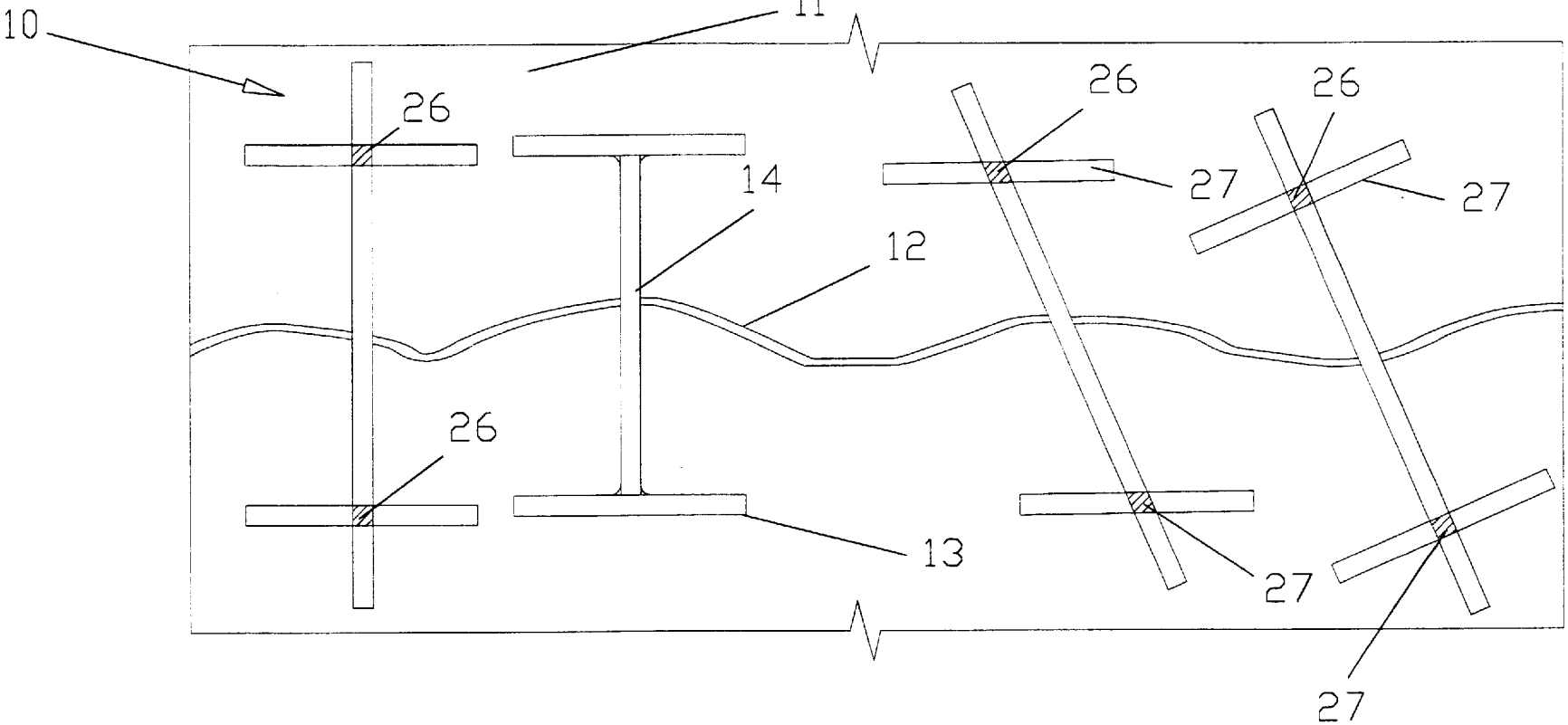
FIG. 10 is a top view of different embodiments of the large metal brackets of the invention.

FIG. 10 shows four stitching brackets 10 positioned across crack 12 in several different positions. There are three alternative assemblies of the large bracket 29 with a first embodiment perpendicular to crack 12. A second embodiment has the large bracket 29 parallel to the crack 12 with the large bracket 29 at an angle to crack 12. A third embodiment has the large bracket 29 at an angle to crack 12 with the end brackets at 90° to the large bracket 29. A fourth embodiment shows the large bracket 14 with end brackets 13 welded at the ends.

Figure 11:
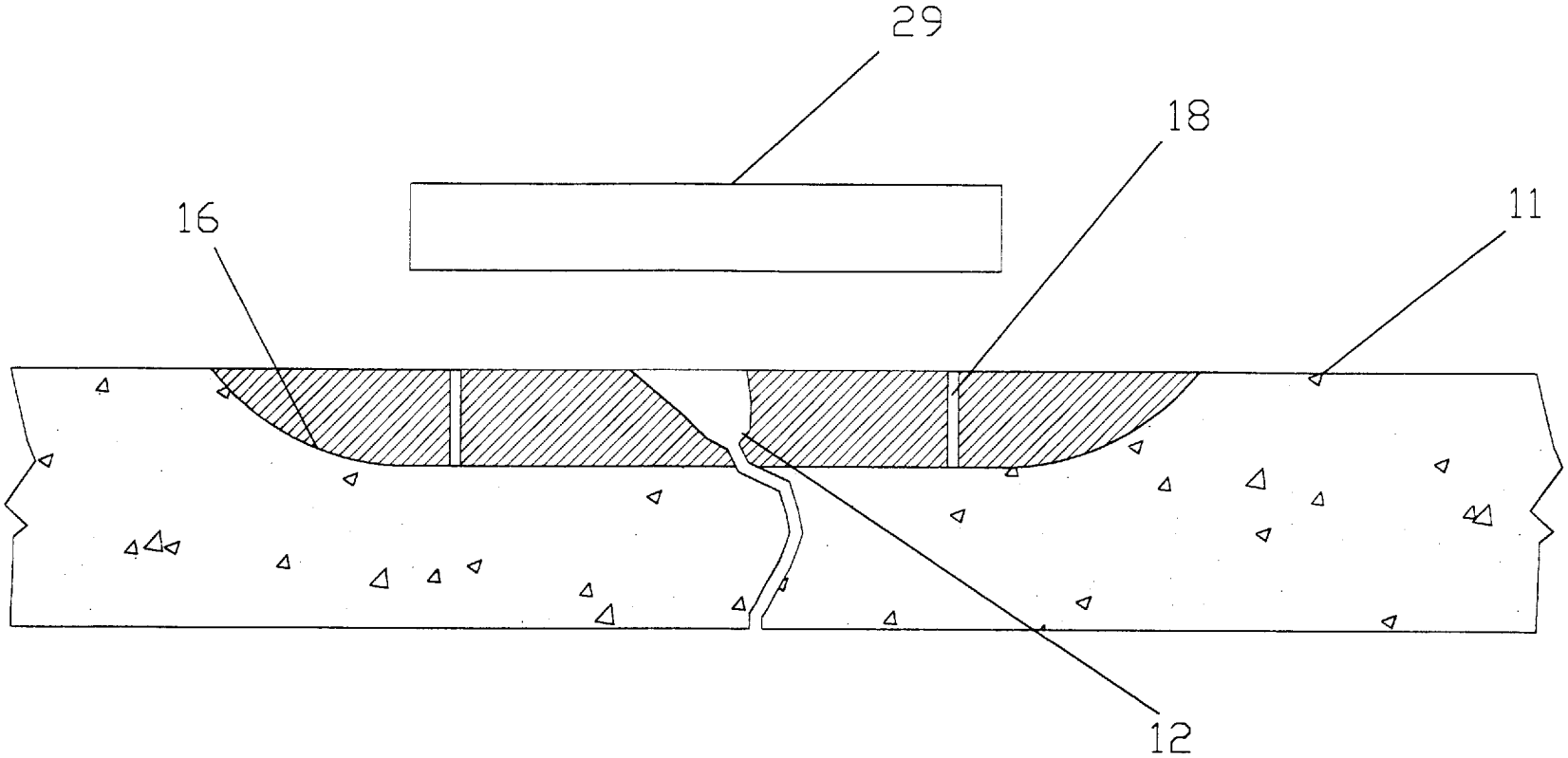
FIG. 11 is a side view of a saw cut in concrete and a large metal bracket before assembly in the saw cut.
Figure 12:
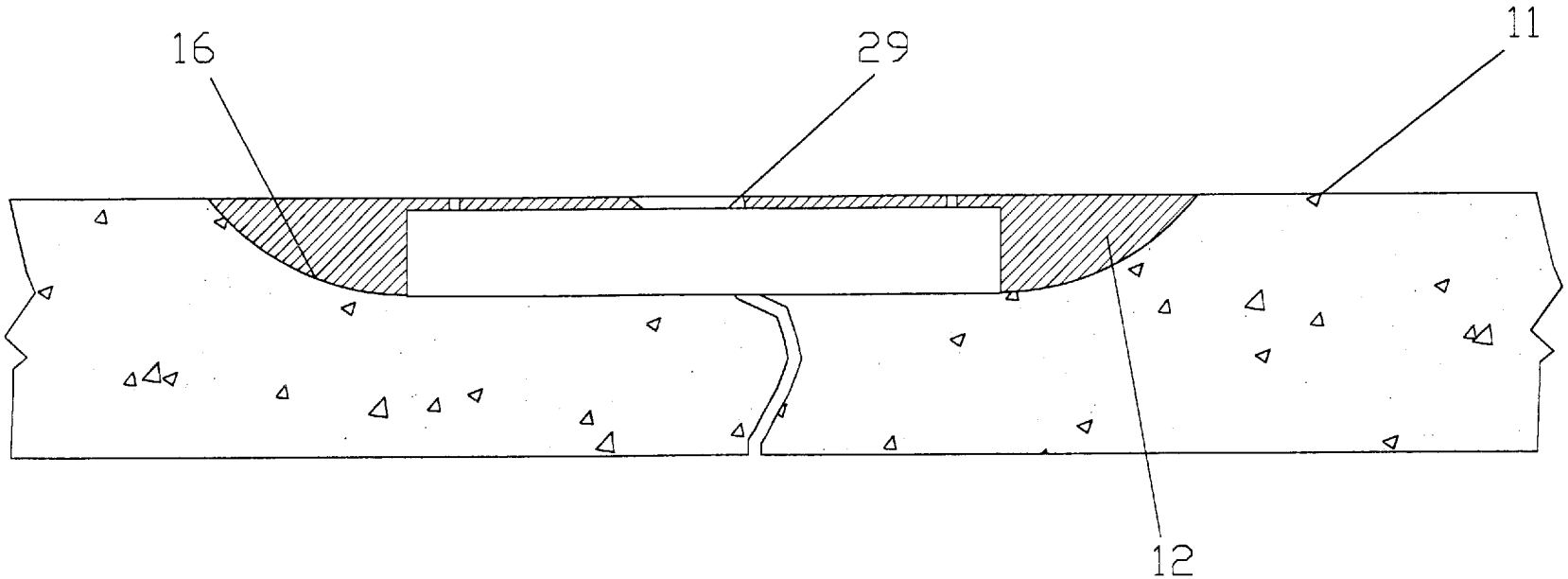
FIG. 12 is a side view, in section, of a large metal bracket installed in the saw cut.
Figure 13:
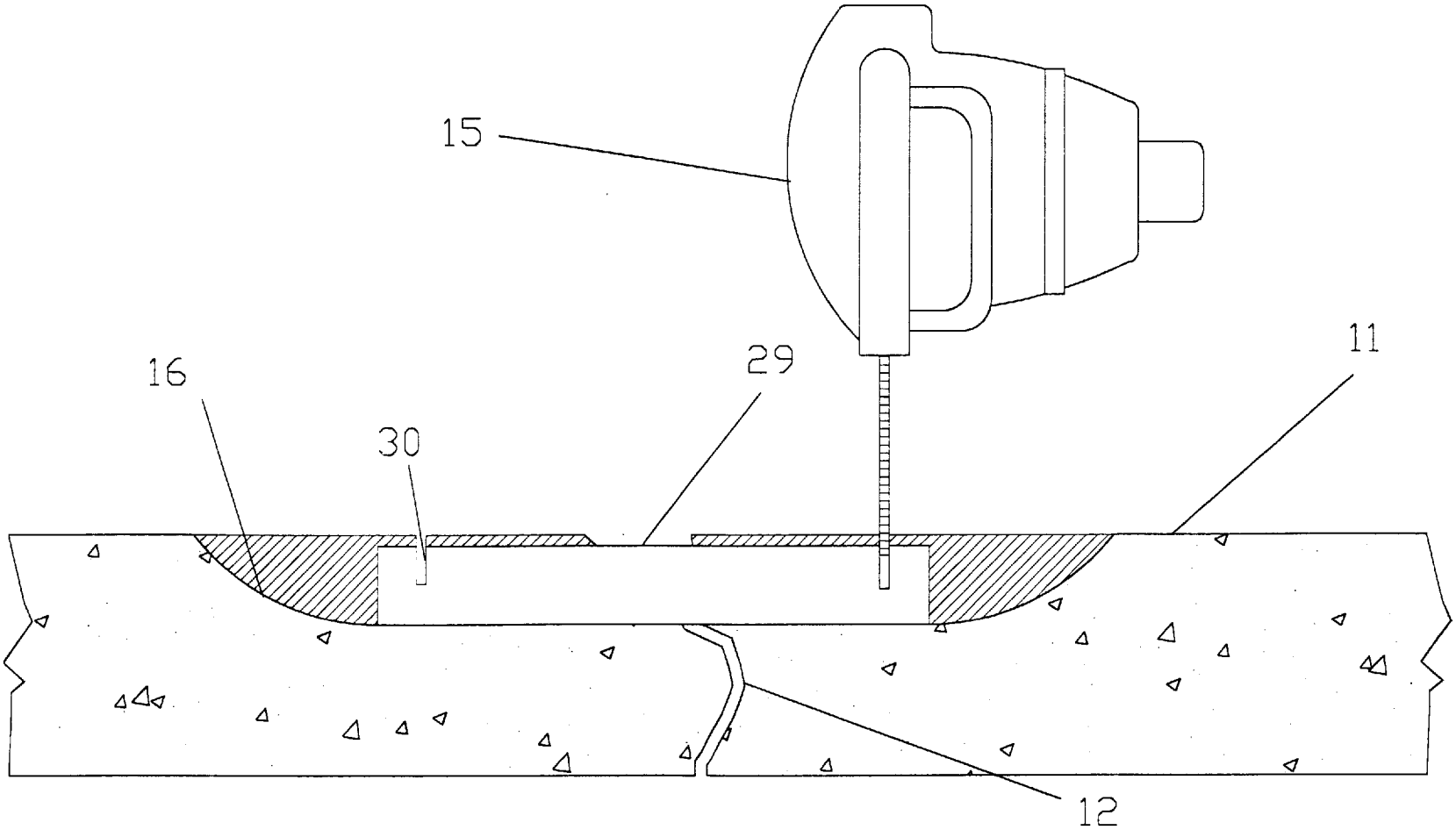
FIG. 13 is a side view, in section, of a saw cut being made in the large metal bracket.

FIG. 11 shows the first step in the process of installing one embodiment of the bracket 10 and begins with inserting the large bracket 29 in the saw cut 16. FIG. 12 shows the large bracket 29 seated in the saw cut 16. The large metal bracket 29 is then placed into and seated in the concrete saw cut 16, with the top surface ¼" below the concrete slab surface 11. FIG. 13 shows the saw 15 being used to cut a slot 30 in the large bracket 29 and in the concrete 11. With the large metal bracket 29 resting in the saw cut 16, the large bracket 29 is then measured and marked one inch from each end. A saw cut 30 is then made at the 1" mark, in the concrete and simultaneously through large metal bracket 29, perpendicular to the large metal bracket 29 or generally parallel to the concrete crack 12. The large bracket 29 and the concrete section 11 are cut to a sufficient depth that will permit the small end brackets 27 to be inserted again, ¼" below the concrete section top surface 11. In a preferred embodiment the end brackets 27 were made from metal, 1"×2"×⅛".

Figure 14:
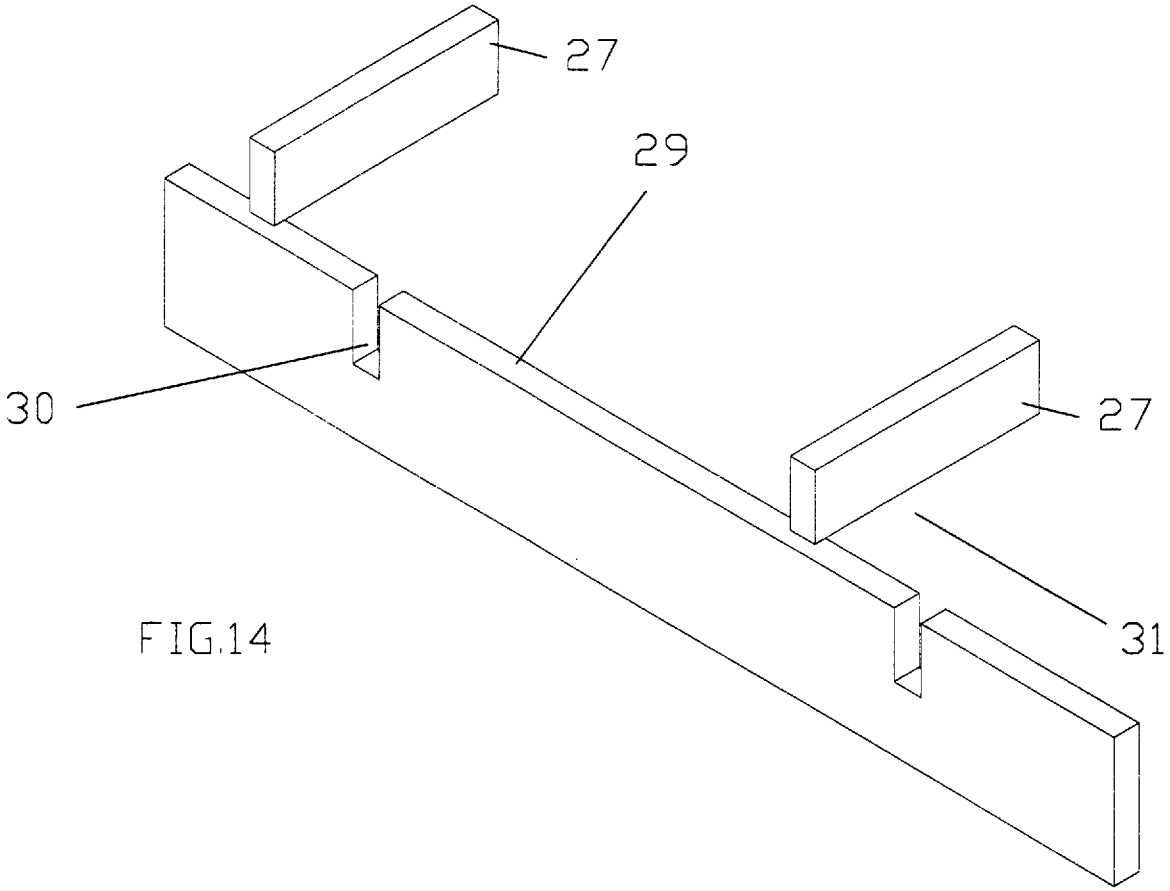
FIG. 14 is a top perspective view of a large metal bracket and an end bracket before mating.
Figure 15:
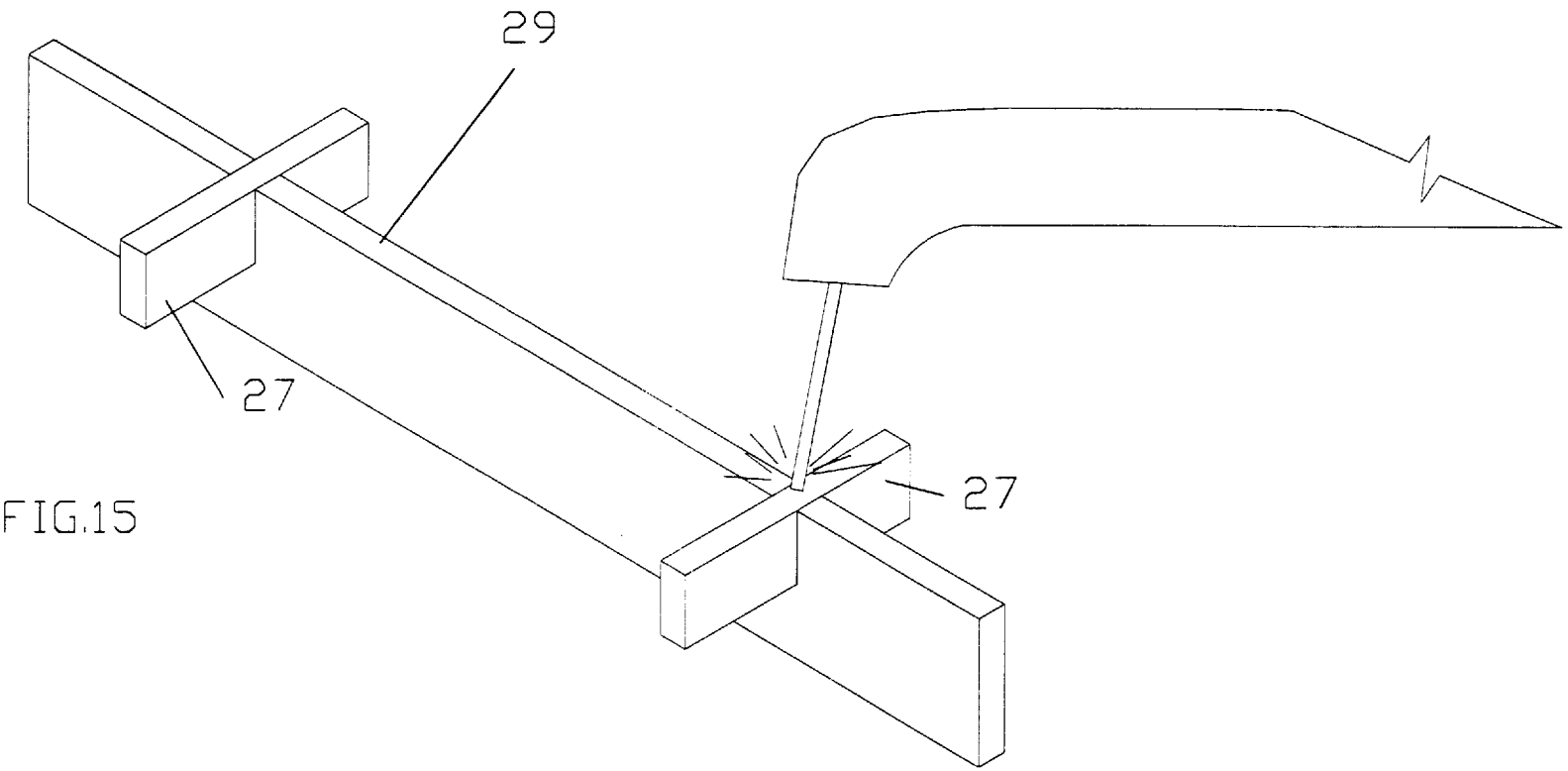
FIG. 15 is a top perspective view of the mated brackets being welded.
Figure 16:
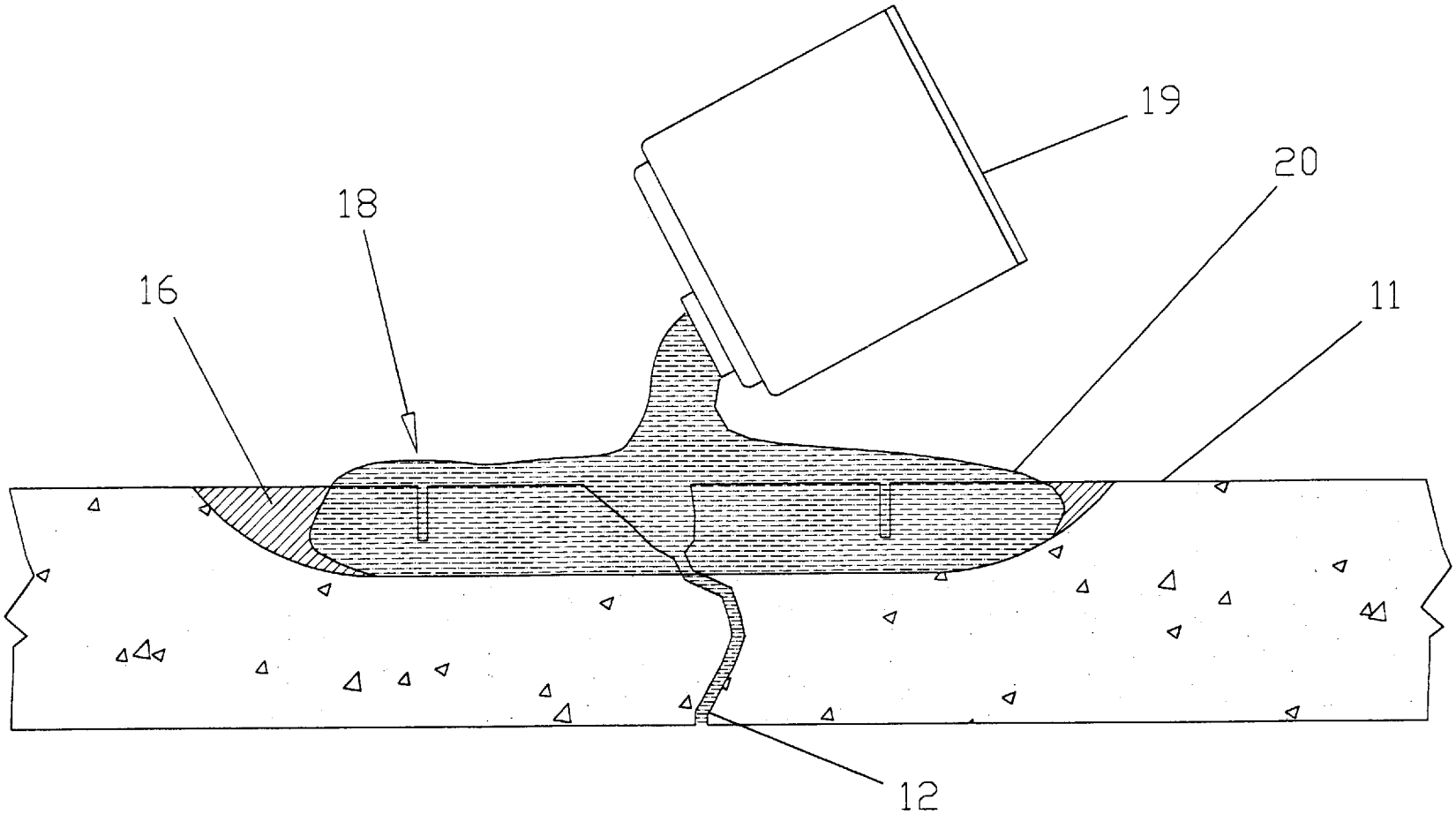
FIG. 16 is a side view showing the resin filler mix being poured into the saw cuts in the concrete section.
Figure 17:
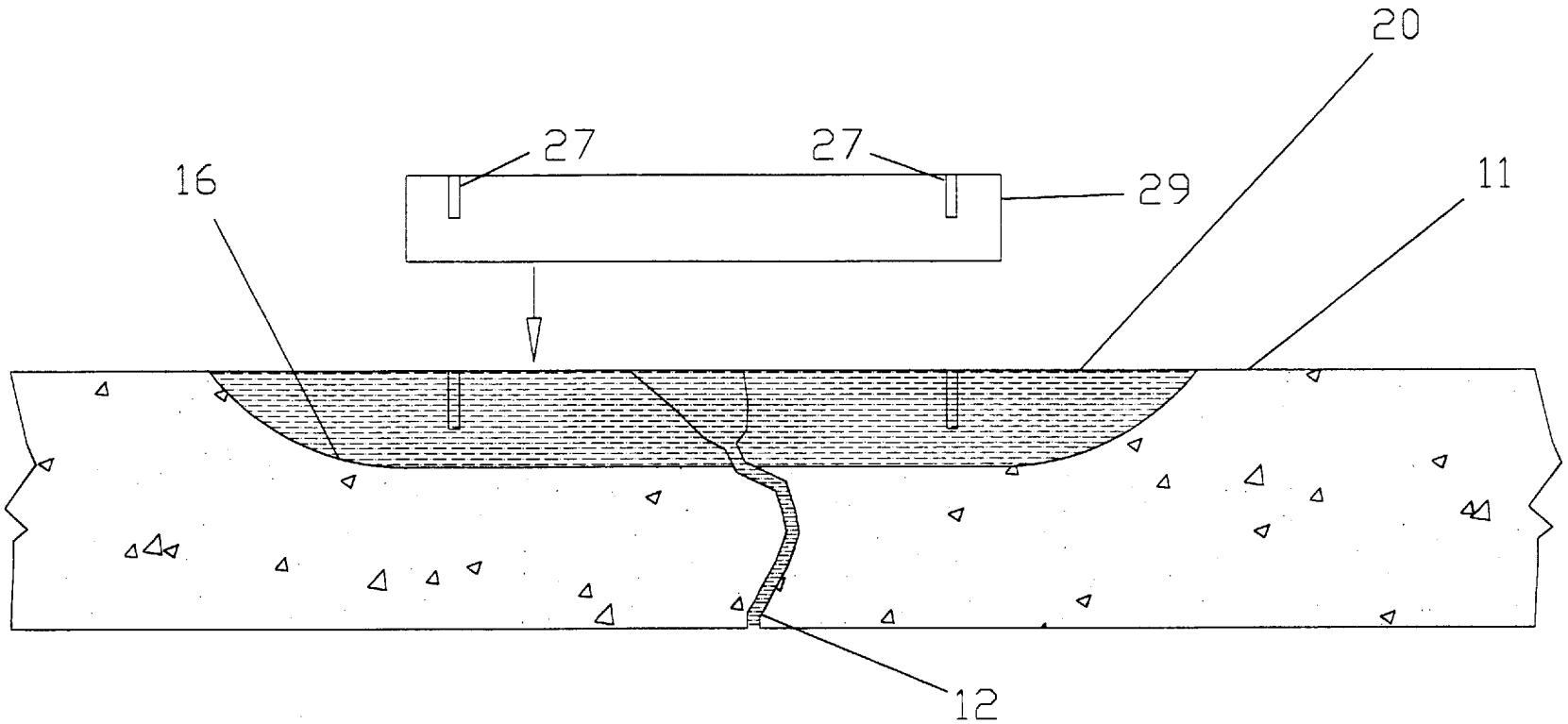
FIG. 17 is a side view showing the large metal bracket and the end bracket being installed into the resin mix filled cut in the concrete slab.
Figure 18:
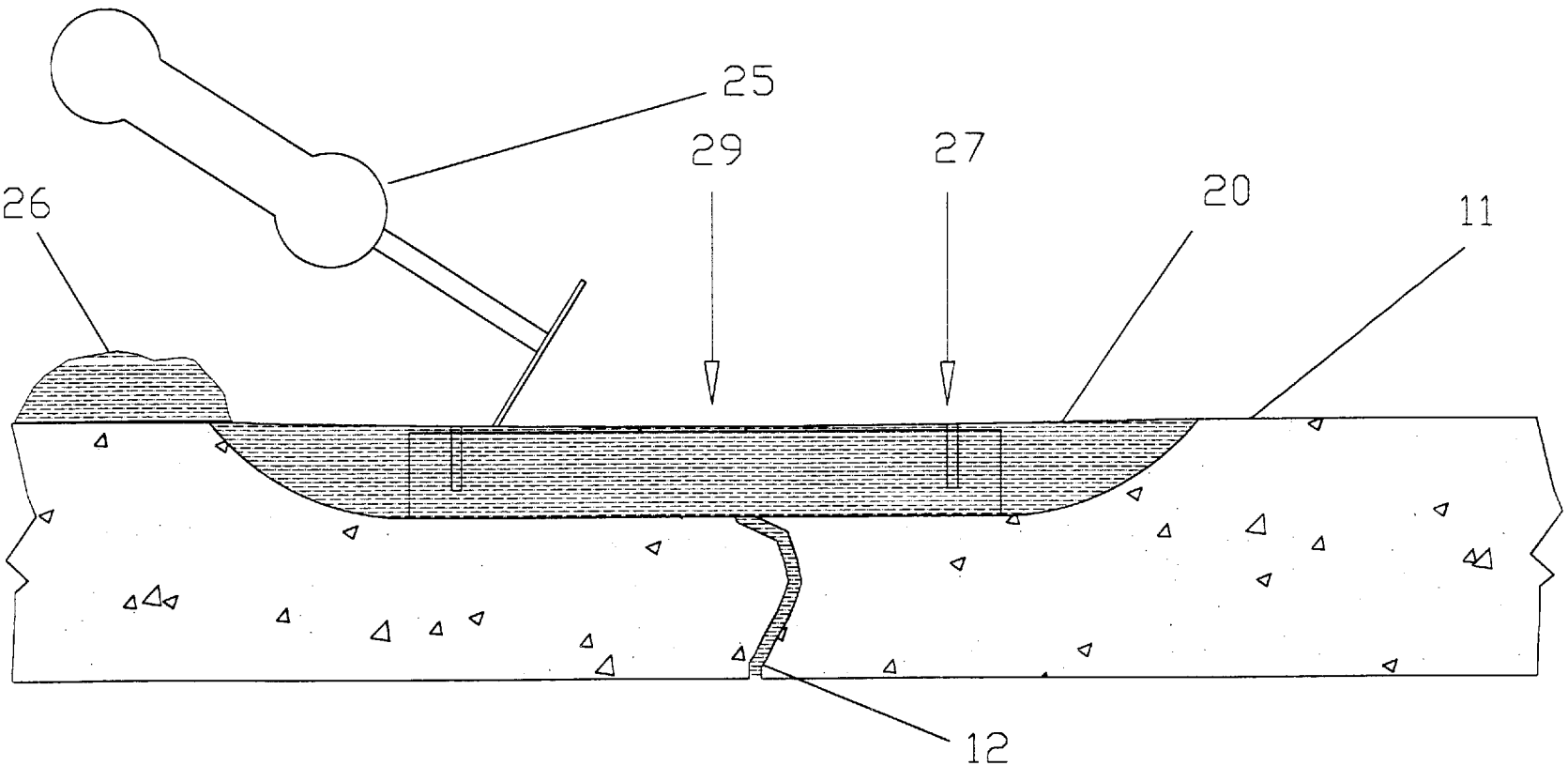
FIG. 18 is a side view showing the filler mix being squeegeed to provide a level surface.
Figure 19:
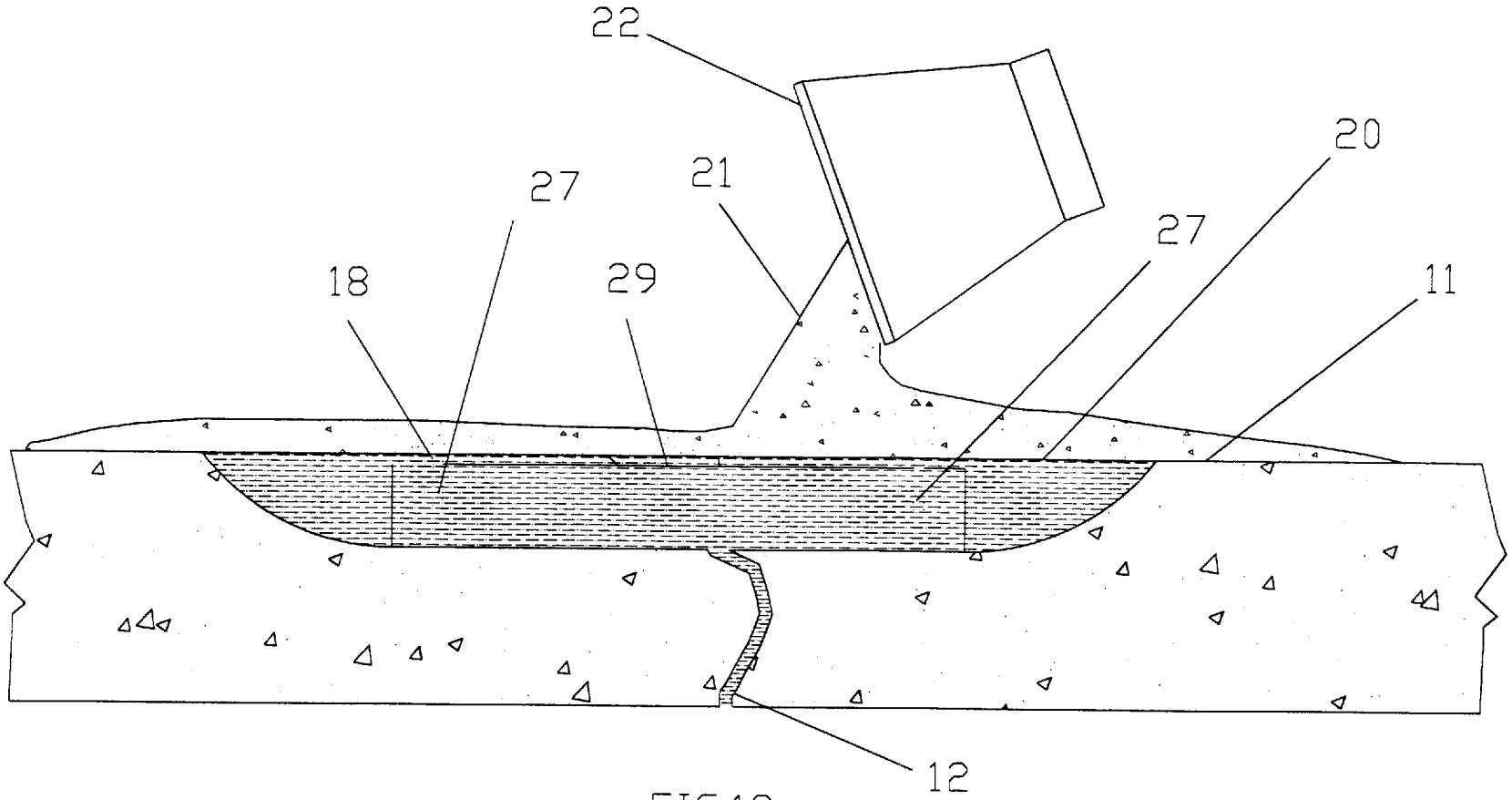
FIG. 19 is a side view showing the application of a second coating over the stitched area.
Figure 20:
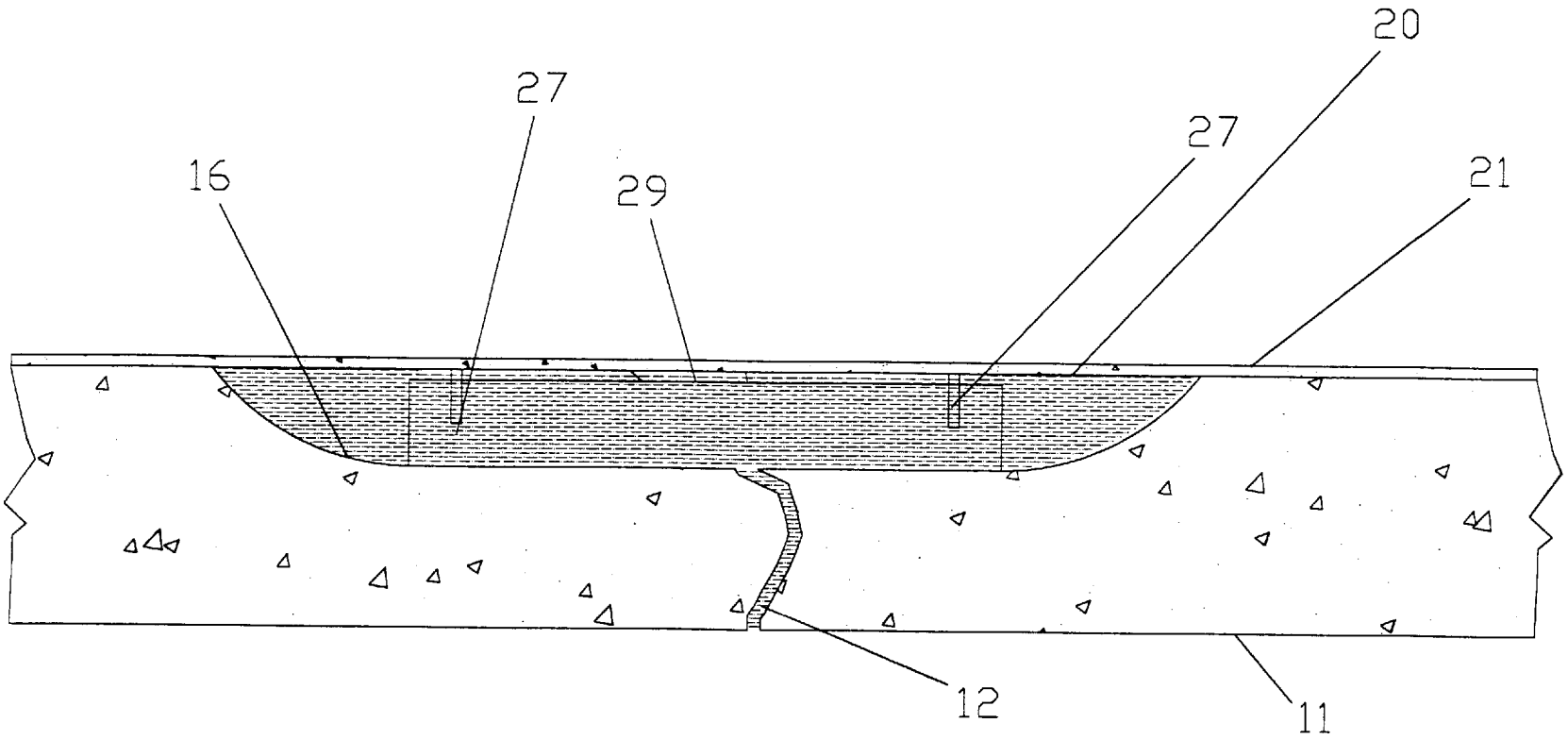
FIG. 20 is a side view showing a finished application of the second coating.
Figure 21:
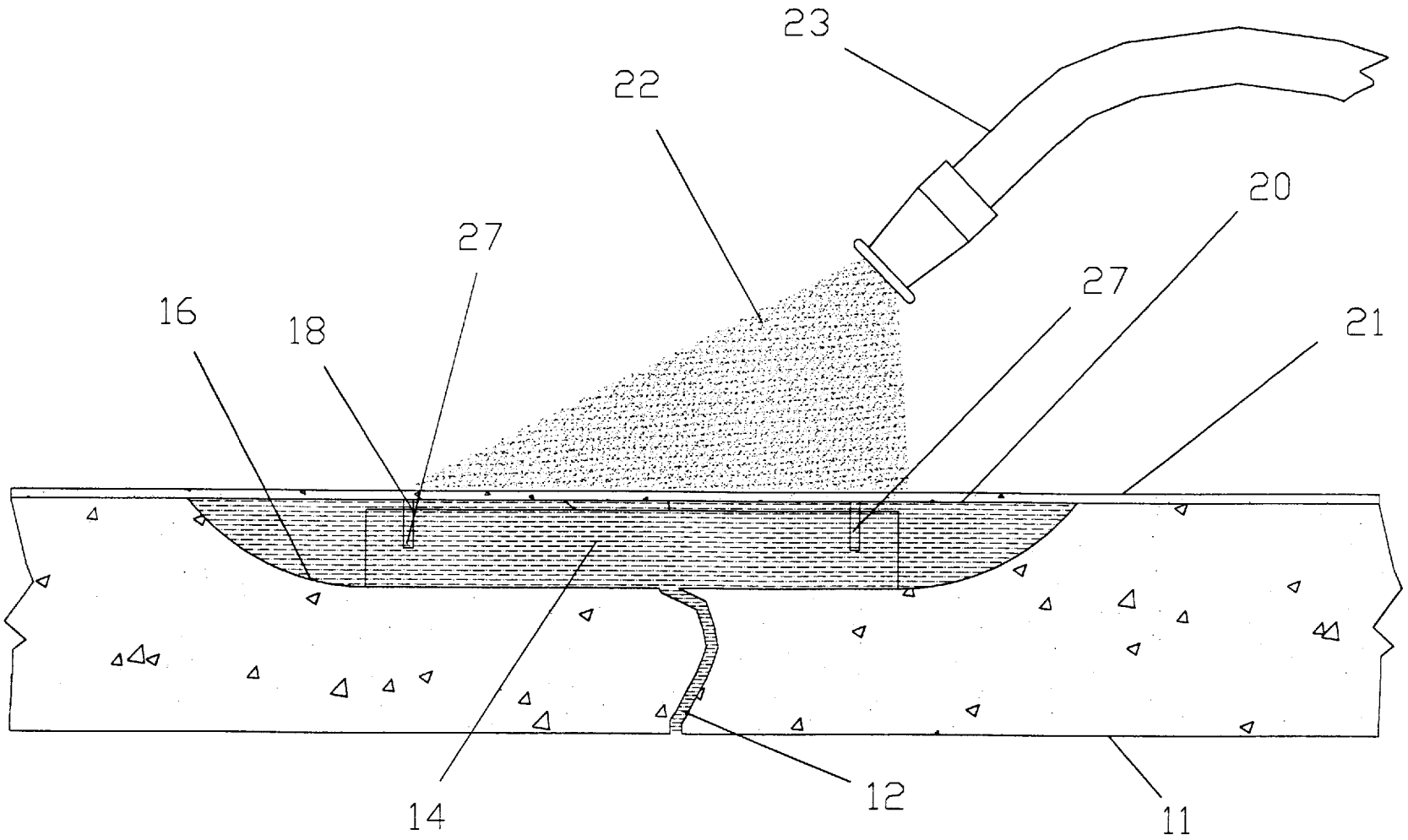
FIG. 21 is a side view of a spray application of a final coating.

FIG. 14 shows the end brackets 27 as they are being inserted in the slots 30 cut in large bracket 29. FIG. 15 shows the end brackets 27 being welded by welder 40 as at weld spot 26. The end brackets 27 are used to precisely stabilize and lock movement of the large brackets 29.

Each of the bracket 20 assemblies are then removed from the concrete slots and numbered to assure that each of the assemblies is returned to the original site. Each bracket 10 should be returned to its respective slot from which it was removed. The saw cuts 16 and 30 are then cleaned, either with a vacuum or by blowing, if the cut was made with a dry cut saw. If the cut was made with a wet cut, the cut should be acid etched and pressure cleaned. The slot should be allowed to dry and a propane torch may be used for drying.

The next step of the process is to mix the crack filler 20, which includes a polyester epoxy resin filler, a filler additive (calcium carbonate), and a catalyst in a container 19. Since the filler and catalyst 20 contain toxic materials, the operator should wear gloves in the preparation of the filler 20. The crack filler mix 20 is then poured into the clean, dry crack 12, as well as the clean, dry concrete saw cuts 16 and 18. After the crack 12 and saw cuts 16 and 18 are filled, the welded brackets 10 are inserted in saw cuts 16 and 18 and hammered down to be seated in the saw cuts 16 with the top surface ¼" below the top surface of concrete 11, with the top surface ¼" below the top surface of concrete 11.

The filler 20 is then smoothed out with a squeegee or trowel 25 and the surplus 26 removed. Additional mixed filler 20 may be added if required to achieve concrete level. The excess resin filler 20 can easily be scraped flush to the surface while curing. When cured, grinding would be necessary and scraping would be ineffective. Once scraped or ground smooth, the repair is complete, although a polymer modified cement 21 may be mixed in container 19, spray applied and broom finished to achieve a natural look, broom finished concrete surface. A final decorative surface 22 may be applied with spray hose 23 and finished with a pattern tool or skip troweled.

In a preferred embodiment, the metal stitch kit of the invention for repairing an average of 32 linear feet, comprised 16 large metal brackets 29 (8200 lbs. tensile strength), 32 small end brackets 27, 1 gallon of crack filler 20 with hardener (11,000 P.S.I. of compressive strength), 14 pounds of filler additive (calcium carbonate-crushed, powdered stone) and complete detailed instructions. After the crack 12 is prepared, it should then be measured and marked one foot from both ends of the crack divided in approximately two foot intervals.

Figure 22:
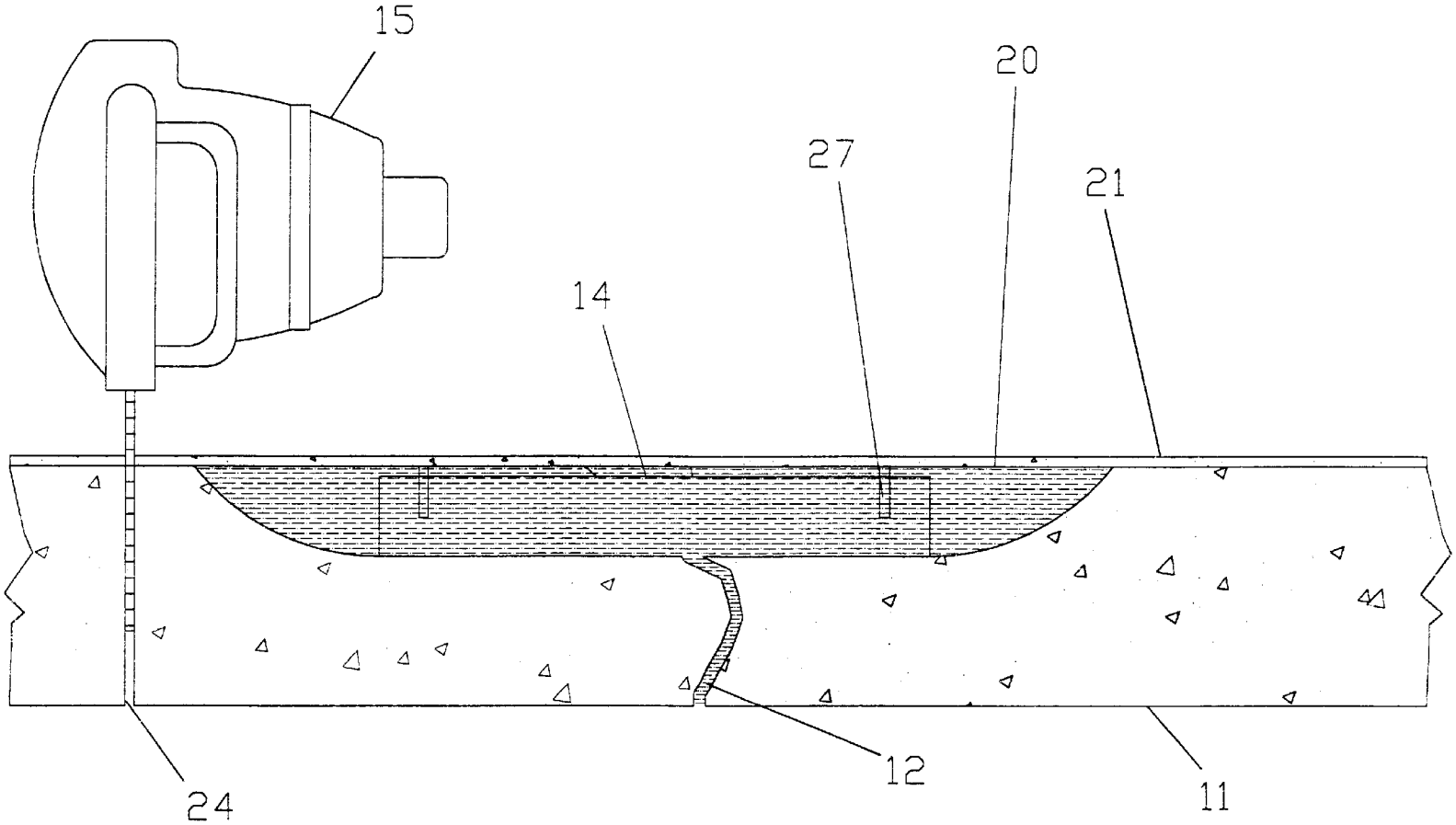
FIG. 22 is a side view of a new control cut in the concrete section.
Figure 23:
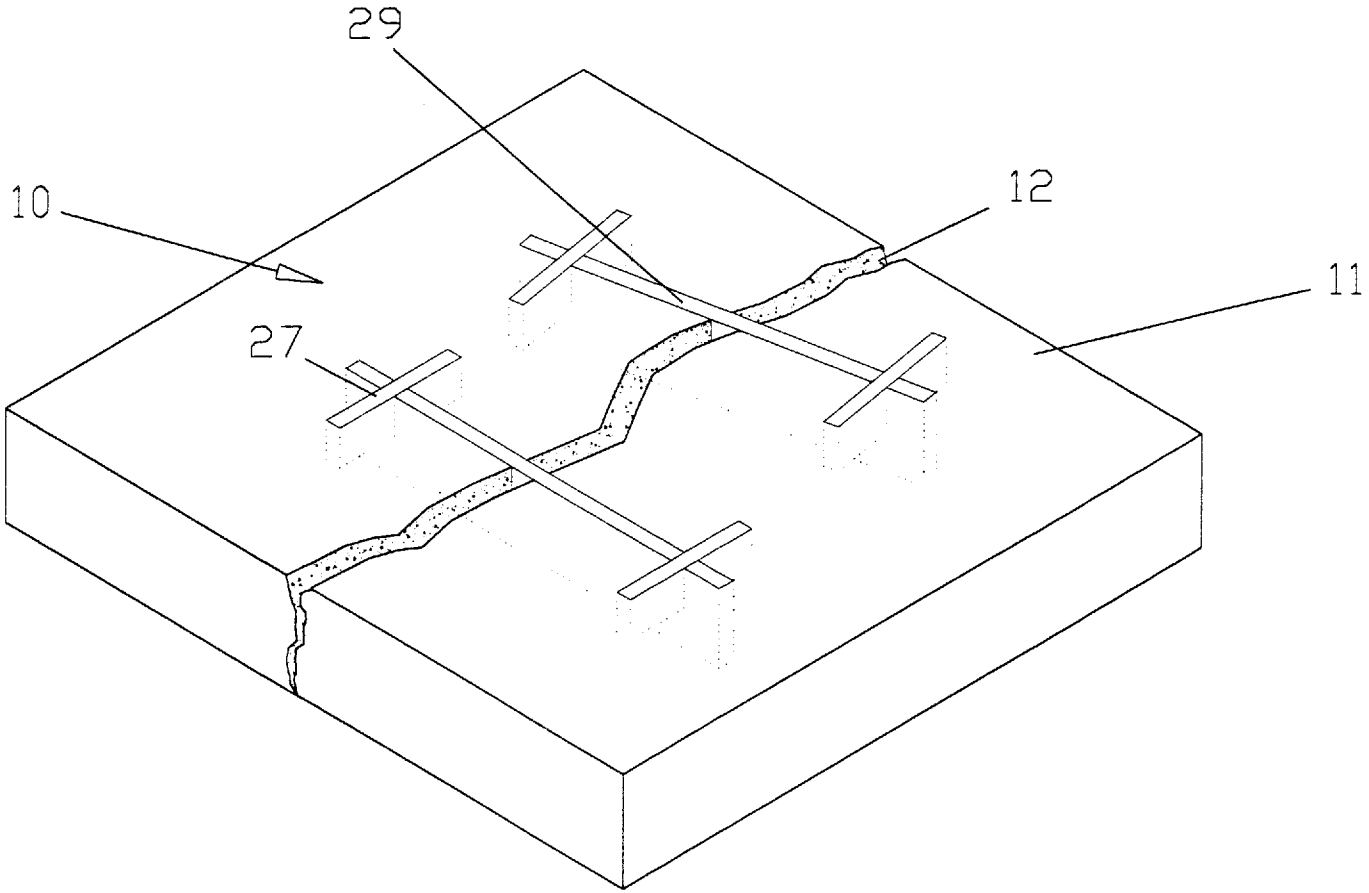
FIG. 23 is a top perspective view of the welded metal brackets inserted into the saw cuts.

Quite often, existing, shallow score cuts do not function to allow for expansion and contraction. If there is a score joint near the repair, it should be re-cut through the entire thickness of the slab to relieve all further stresses from the repair area. As shown in FIG. 22, if a score cut 24 is not present, it should be made within a short distance from the repair. A clear proof test of expansion and contraction is to place a snugly fitted nail in a crack when the concrete is cool (early in the morning) and it will lock up tight in the afternoon with the heat of the sun.

The process and system of the invention provide many features not available in the prior art. The invention is convenient and easy to install and provides a rugged, inexpensive solution to a common problem of concrete cracks. The invention kit comes with full instructions and video. It is a fast repair, 32 linear feet repaired in approximately 2 hours. Each kit adds in excess of 128,000 pounds of tensile strength per 32 linear feet of cracks. A new control cut 24 relieves stress from the repaired area if required. The kit is inexpensive, especially when compared to the cost of replacing the entire concrete area.

The present embodiments of the invention are thus to be considered in all respects as illustrative and not restrictive, the scope of the invention being indicated by the appended claims rather than by the foregoing description. All changes which come within the meaning and range of equivalency of the claims are intended to be embraced therein.

What is claimed is:

1. An internal metal stitching method for repairing a crack in concrete, the method comprising:

removing loose pieces of concrete from the crack to improve the crack surface for bonding, assembling and welding a plurality of large brackets and end brackets to form metal stitching brackets, said end brackets being attached at opposite ends of said large brackets, marking the concrete at alternating angles to the crack, to the dimensions to be cut using metal stitching brackets as marking templates, cutting a first series of saw cuts in the concrete along a line corresponding to the length of said metal stitching brackets, cutting a second series of saw cuts across said first series of saw cuts along lines corresponding to the width of said metal stitching brackets, said first and second series of saw cuts being sufficiently deep to retain said large and end brackets at least one quarter inch below the surface of the concrete when inserted, cleaning and drying the concrete crack and all of said saw cuts, mixing a resin filler, a filler additive, and a hardener in a container to form a filler material, pouring said filler material into and filling said saw cuts and the crack, inserting said metal stitching brackets in each of their original saw cuts, and seating said large metal brackets below the surface of the concrete, and, smoothing out said filler material to a level flush with the concrete surface and removing excess filler material by scraping or grinding.

2. The internal metal stitching method of claim 1 including the step of applying a coating of a polymer modified cement to the surface of the concrete and brushing said coating to achieve a broom finish.

3. The internal metal stitching method of claim 2 including the step of spraying a material on said coating to form a decorative surface thereon.

4. The internal metal stitching method of claim 1 wherein a first saw cut is made near a first end of said large brackets and a second saw cut is made near a second end of said large brackets, a first end bracket is inserted in said first saw cut and spot welded therein, and a second end bracket is inserted in said second saw cut and spot welded therein.

5. An internal metal stitching method for repairing a crack in concrete, the method comprising:

removing loose pieces of concrete from the crack to improve the crack surface for bonding, cutting a first series of saw cuts in the concrete at alternating angles to the crack, inserting a large metal bracket, having a first and a second end, in each of said first series of saw cuts, cutting a second series of saw cuts in the concrete and simultaneously near a first end of said large metal brackets, cutting a third series of saw cuts in the concrete and simultaneously near a second end of said large metal brackets, inserting an end bracket in each of said second and third series of saw cuts and welding each of said end brackets to said large metal brackets thereby forming a metal stitching bracket, removing said metal stitching brackets from said saw cuts and marking each bracket for return to its original site, cleaning and drying the concrete crack and all of said saw cuts, mixing a resin filler, a filler additive, and a hardener in a container to form a filler material, pouring said filler material into and filling said saw cuts and the crack, replacing said metal stitching brackets in each of their original saw cuts, and sealing said stitching brackets below the surface of the concrete, and smoothing out said filler material to a level flush with the concrete surface and removing excess filler material by scraping or grinding.

* * * * *